US009473849B2

(12) United States Patent
Ding et al.

(10) Patent No.: US 9,473,849 B2
(45) Date of Patent: Oct. 18, 2016

(54) SOUND SOURCE DIRECTION ESTIMATION APPARATUS, SOUND SOURCE DIRECTION ESTIMATION METHOD AND COMPUTER PROGRAM PRODUCT

(71) Applicant: KABUSHIKI KAISHA TOSHIBA, Minato-ku, Tokyo (JP)

(72) Inventors: Ning Ding, Kanagawa (JP); Yusuke Kida, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/629,784

(22) Filed: Feb. 24, 2015

(65) Prior Publication Data

US 2015/0245152 A1 Aug. 27, 2015

(30) Foreign Application Priority Data

Feb. 26, 2014 (JP) ..... 2014-036032

(51) Int. Cl.
*H04R 29/00* (2006.01)
*H04R 1/40* (2006.01)

(52) U.S. Cl.
CPC ..... *H04R 1/406* (2013.01); *H04R 2430/23* (2013.01)

(58) Field of Classification Search
CPC ..... H04R 29/00
USPC ..... 340/943; 342/420; 367/124, 129, 140; 370/280; 379/392.01; 381/56, 71.1, 381/71.5, 92, 97, 71.11; 382/103; 701/117; 704/245, 500, 231, 270
See application file for complete search history.

(56) References Cited

U.S. PATENT DOCUMENTS 5,347,496 A * 9/1994 Clark ..... G01N 29/14 181/0.5
5,878,367 A * 3/1999 Lee ..... H04B 11/00 340/943
7,054,228 B1 * 5/2006 Hickling ..... G01S 5/20 367/124
7,123,727 B2 * 10/2006 Elko ..... H04R 1/406 381/92
7,561,701 B2 * 7/2009 Fischer ..... G01S 3/803 381/26
7,711,127 B2 * 5/2010 Suzuki ..... G10L 21/0272 381/113
7,809,145 B2 * 10/2010 Mao ..... H04R 3/005 381/122
8,155,346 B2 * 4/2012 Yoshizawa ..... G01S 3/8083 381/92

(Continued)

FOREIGN PATENT DOCUMENTS

JP 2003-337164 11/2003
JP 2006-254226 9/2006

(Continued)

*Primary Examiner* — Gerald Gauthier
(74) *Attorney, Agent, or Firm* — Nixon & Vanderhye, P.C.

(57) ABSTRACT

According to an embodiment, a sound source direction estimation apparatus includes an acquisition unit, a generator, a comparator, and an estimator. The acquisition unit is configured to acquire acoustic signals of a plurality of channels from a plurality of microphones. The generator is configured to calculate a phase difference of the acoustic signals of the plurality of channels for each predetermined frequency bin to generate a phase difference distribution. The comparator is configured to compare the phase difference distribution with a template generated in advance for each direction, and calculate a score in accordance with similarity between the phase difference distribution and the template for each direction. The estimator is configured to estimate a direction of a sound source based on the scores calculated.

17 Claims, 22 Drawing Sheets

(56) References Cited

U.S. PATENT DOCUMENTS

| | | | | |
|---|---|---|---|---|
| 8,218,786 | B2 * | 7/2012 | Koga | H04R 3/005 381/122 |
| 8,265,341 | B2 * | 9/2012 | Dernis | G06K 9/00892 379/88.01 |
| 8,352,274 | B2 * | 1/2013 | Yoshizawa | G10L 21/0208 704/270 |
| 8,494,863 | B2 * | 7/2013 | Biswas | G10L 19/035 704/205 |
| 8,767,973 | B2 * | 7/2014 | Andrea | H04R 3/005 381/71.11 |
| 8,990,078 | B2 * | 3/2015 | Nakadai | G08B 5/00 381/58 |
| 9,103,908 | B2 * | 8/2015 | Park | G01S 15/04 |
| 9,106,196 | B2 * | 8/2015 | Hetherington | H03G 3/20 |
| 9,111,526 | B2 * | 8/2015 | Visser | G10L 19/008 |
| 9,129,611 | B2 * | 9/2015 | Nishino | G10L 25/51 |
| 2004/0170287 | A1 * | 9/2004 | Biwa | G10K 11/22 381/71.5 |
| 2006/0146648 | A1 * | 7/2006 | Ukita | H04N 7/15 367/129 |
| 2006/0204019 | A1 * | 9/2006 | Suzuki | G10L 21/0272 381/92 |
| 2006/0215853 | A1 * | 9/2006 | Hiruma | H04S 7/30 381/97 |
| 2010/0111290 | A1 * | 5/2010 | Namba | H04M 1/6008 379/392.01 |
| 2010/0295732 | A1 * | 11/2010 | Lee | G01S 3/48 342/420 |
| 2013/0028151 | A1 * | 1/2013 | Ning | H04B 7/2643 370/280 |
| 2013/0328701 | A1 * | 12/2013 | Sato | G01S 3/808 340/943 |
| 2015/0055788 | A1 * | 2/2015 | Zakis | H04R 3/002 381/71.1 |
| 2015/0081298 | A1 * | 3/2015 | Ding | G10L 15/20 704/245 |
| 2015/0245152 | A1 * | 8/2015 | Ding | H04R 1/406 381/56 |

FOREIGN PATENT DOCUMENTS

| | | |
|---|---|---|
| JP | 2006-267444 | 10/2006 |
| JP | 2008-079255 | 4/2008 |
| JP | 2009-080309 | 4/2009 |
| JP | 4339929 | 7/2009 |
| WO | 2009/044509 | 4/2009 |

* cited by examiner

FIG.4

| DIRECTION ANGLE (°) / FRE-QUENCY (kHz) | ··· | -60 | ··· | 30 | ··· | 90 |
|---|---|---|---|---|---|---|
| 1 | ··· | -0.50204 | ··· | 0.289855 | ··· | 0.57971 |
| 2 | ··· | -1.00409 | ··· | 0.57971 | ··· | 1.15942 |
| 3 | ··· | -1.50613 | ··· | 0.869565 | ··· | 1.73913 |
| 4 | ··· | -2.00817 | ··· | 1.15942 | ··· | 2.318841 |
| 5 | ··· | -2.51022 | ··· | 1.449275 | ··· | 2.898551 |
| 6 | ··· | -3.01226 | ··· | 1.73913 | ··· | -2.80492 |
| 7 | ··· | 2.768879 | ··· | 2.028986 | ··· | -2.22521 |
| 8 | ··· | 2.266836 | ··· | 2.318841 | ··· | -1.6455 |

SOUND SOURCE DIRECTION ESTIMATION APPARATUS, SOUND SOURCE DIRECTION ESTIMATION METHOD AND COMPUTER PROGRAM PRODUCT

CROSS-REFERENCE TO RELATED APPLICATION

This application is based upon and claims the benefit of priority from Japanese Patent Application No. 2014-036032, filed on Feb. 26, 2014; the entire contents of which are incorporated herein by reference.

FIELD

Embodiments described herein relate generally to a sound source direction estimation apparatus, a sound source direction estimation method and a computer program product.

BACKGROUND

As a technique for accurately estimating a sound source direction without depending on the distance from a sound source to a microphone, there is a technique that utilizes a phase difference distribution generated from acoustic signals of a plurality of channels. The phase difference distribution is a distribution representing phase differences for individual frequencies of the acoustic signals of a plurality of channels, and has a specific pattern dependent on the direction of a sound source in accordance with the distance between the microphones collecting a sound from the acoustic signals of the plurality of channels. This pattern is unchanged even when the sound pressure level difference of the acoustic signals of the plurality of channels is small. For this reason, even when a sound source is located away from microphones causing a sound pressure level difference of acoustic signals of a plurality of channels to be small, the use of a phase difference distribution enables the direction of a sound source to be accurately estimated.

However, in the conventional technology of estimating the direction of a sound source using a phase difference distribution, the calculation amount required for the processing of obtaining a direction from a phase difference distribution is large, thereby inhibiting the direction of a sound source from being estimated in real time with equipment having low calculation capacity. For this reason, it is demanded that estimation of a sound source direction using a phase difference distribution be performed in a low calculation amount.

BRIEF DESCRIPTION OF THE DRAWINGS

FIG. 4 is a diagram illustrating an example of phase difference distributions for individual directions used in templates;

DETAILED DESCRIPTION

According to an embodiment, a sound source direction estimation apparatus includes an acquisition unit, a generator, a comparator, and an estimator. The acquisition unit is configured to acquire acoustic signals of a plurality of channels from a plurality of microphones. The generator is configured to calculate a phase difference of the acoustic signals of the plurality of channels for each predetermined frequency bin to generate a phase difference distribution. The comparator is configured to compare the phase difference distribution with a template generated in advance for each direction, and calculate a score in accordance with similarity between the phase difference distribution and the template for each direction. The estimator is configured to estimate a direction of a sound source based on the scores calculated.

First Embodiment

Figure 1:
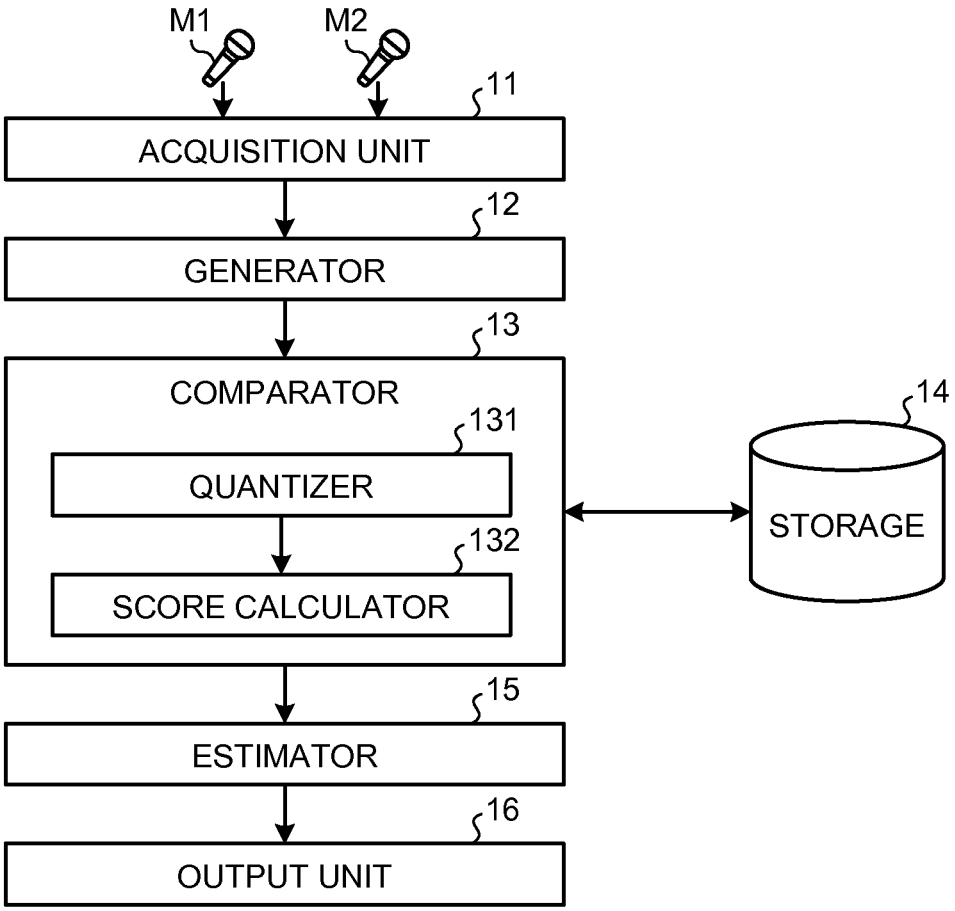
FIG. 1 is a block diagram illustrating a functional configuration example of a sound source direction estimation apparatus according to a first embodiment.

FIG. 1 is a block diagram illustrating a functional configuration example of a sound source direction estimation apparatus according to a first embodiment. The sound source direction estimation apparatus according to the present embodiment includes, as illustrated in FIG. 1, an acquisition unit 11, a generator 12, a comparator 13, a storage 14, an estimator 15, and an output unit 16.

The acquisition unit 11 acquires acoustic signals of a plurality of channels from a plurality of microphones constituting a microphone array. In the present embodiment, as illustrated in FIG. 1, acoustic signals of two channels are acquired from two microphones M1 and M2. The two microphones M1 and M2 constituting a microphone array have a fixed relative positional relationship, and the distance between the two microphones is never changed. When a sound source is a human (a speaker), for example, an acoustic signal is a voice signal such as speech by a speaker.

The generator 12 calculates a phase difference of the acoustic signals of the plurality of channels acquired by the acquisition unit 11, for each predetermined frequency bin, to generate a phase difference distribution.

Specifically, the generator 12 converts each of the acoustic signals of the two channels acquired by the acquisition unit 11, from a time-domain signal into a frequency-domain signal, through Fast Fourier Transform (FFT) or the like. Then, the generator 12 calculates a phase difference $\phi(\omega)$ of the two channels for each signal frequency according to Equation (1) below, thereby to generate a phase difference distribution.

$$\phi(\omega) = \arg\left[\frac{X_2(\omega)}{X_1(\omega)}\right] \tag{1}$$

Here, $\omega$ is a frequency; $X_1(\omega)$ is a signal of one of the two channels in frequency domain; and $X_2(\omega)$ is a signal of the other of the two channels in frequency domain. The period of a calculated phase difference is $2\pi$. In the present embodiment, the range of the phase difference is defined as a range of not less than $-\pi$ and not more than $\pi$. It is noted that a different range of a phase difference may be defined, for example, a range of not less than 0 and not more than $2\pi$.

Figure 2:
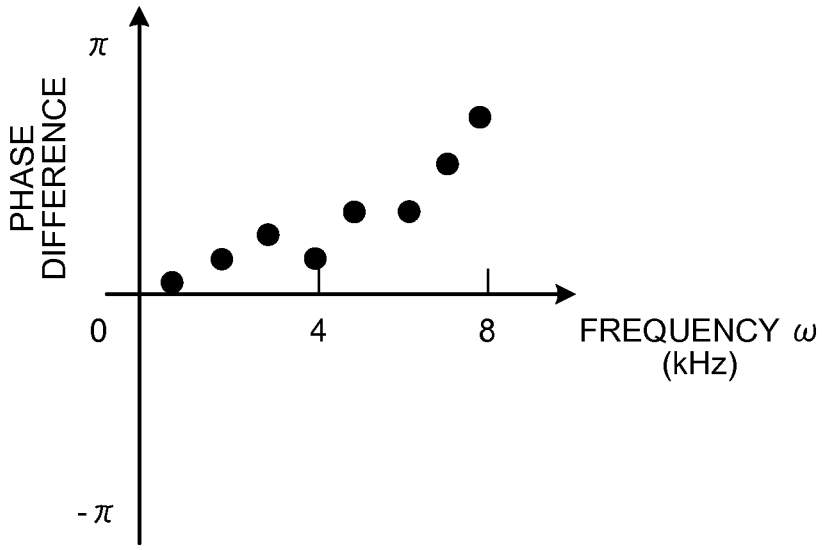
FIG. 2 is a diagram illustrating an example of a phase difference distribution.

An example of the phase difference distribution is illustrated in FIG. 2. In the present embodiment, a frequency bin is defined for each 1 kHz in a range of not less than 1 kHz and not more than 8 kHz. The generator 12 calculates a phase difference of acoustic signals of two channels for each predetermined frequency bin, to generate a phase difference distribution such as that illustrated in FIG. 2.

The comparator 13 compares the phase difference distribution generated by the generator 12 to a template generated in advance for each direction, and calculates a score in accordance with similarity between the both for each direction. For calculating the similarity, the distance between the both, for example, may be utilized. In the present embodiment, the comparator 13 treats a quantized phase difference distribution as an image, and calculates a score corresponding to a degree to which the quantized phase difference distribution overlaps with the template. For this reason, the comparator 13 has a configuration including a quantizer 131 and a score calculator 132.

The quantizer 131 quantizes the phase difference distribution generated by the generator 12. The quantized phase difference distribution $q(\omega,n)$ is represented by Equation (2) below:

$$q(\omega, n) = \begin{cases} 1, & \text{if } n = \left\lfloor \frac{\phi(\omega)}{\alpha} \right\rfloor \\ 0, & \text{otherwise} \end{cases} \tag{2}$$

Here, $\alpha$ is a quantization coefficient; and n is an index indicating a value of a phase difference quantized for each frequency bin. The quantization coefficient $\alpha$ may be defined in accordance with a necessary resolution. In the present embodiment, the quantization coefficient $\alpha$ is defined as $\pi/5$. In this case, the index n indicates a value of a phase difference quantized in a unit of $\pi/5$.

Figure 3:
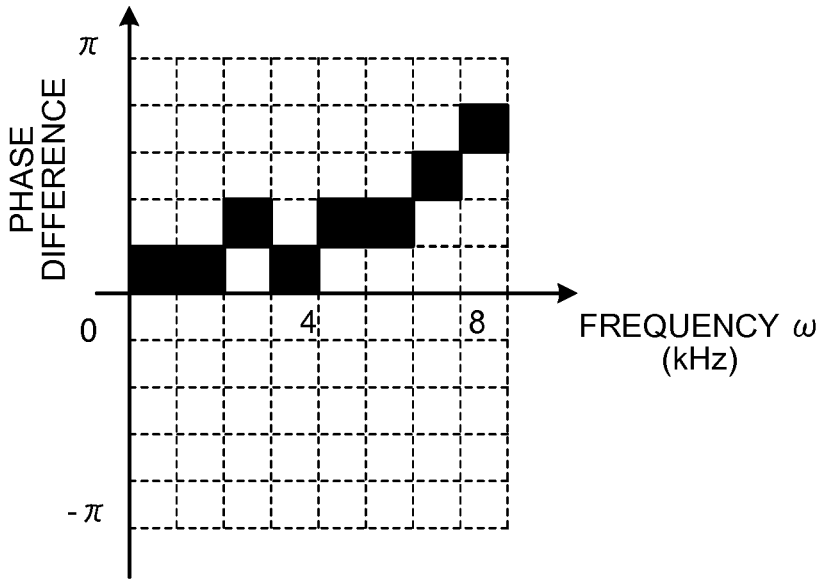
FIG. 3 is a diagram illustrating an example of a quantized phase difference distribution.

An example of the quantized phase difference distribution is illustrated in FIG. 3. The quantizer 131 quantizes the phase difference distribution generated by the generator 12 to generate a quantized phase difference distribution such as that illustrated in FIG. 3.

The score calculator 132 compares the quantized phase difference distribution with a template generated in advance for each direction, and calculates the number of frequency bins where the both overlap with each other, specifically the number of frequency bins where the quantized phase differences in the phase difference distribution and in the template are identical, as a score for a direction corresponding to the template.

Here, a template used for the score calculation in each direction will be described. A template is prepared in advance by quantizing a phase difference distribution for each direction calculated using a known distance between microphones in advance, in the same method as in the quantizer 131 (for example, the quantization coefficients are the same). A phase difference distribution $\phi(\omega, \theta)$ for each direction to be used for a template is obtained according to a calculation equation of Equation (3) below.

$$\Phi(\omega, \theta) = \frac{d}{c}\omega \cdot \sin\theta \tag{3}$$

Here, d is a distance between two microphones M1 and M2 constituting a microphone array; c is an acoustic velocity; and $\theta$ is an angle (deg.) formed by a direction in which a phase difference distribution is calculated with respect to a straight line connecting the positions of two microphones M1 and M2. Hereinafter, this angle is referred to as a direction angle. The direction angles in which templates are prepared in advance may be defined according to a necessary angle resolution within an angle range that becomes a target of direction estimation.

An example of phase difference distributions for individual directions used in the templates is illustrated in FIG. 4. In the present embodiment, templates are prepared in advance for each 1 degree within an angle range of a direction angle of not less than −90 degrees and not more than 90 degrees. The example illustrated in FIG. 4 indicates phase difference distributions calculated for each 1 degree within an angle range of not less than −90 degrees and not more than 90 degrees when an inter-microphone distance d is 0.2 m. Here, for convenience, there are listed only phase difference distributions for the direction angles $\theta$ of −60 degrees, 30 degrees and 90 degrees, that is, values (values of not less than $-\pi$ and not more than $\pi$) of phase differences for individual frequency bins in these direction angles $\theta$.

The phase difference distributions for individual directions calculated as above are quantized in the same method as in the quantizer 131, and stored as templates for individual directions in the storage 14 disposed inside or outside the sound source direction estimation apparatus. A template $Q(\omega, \theta, n)$ to be prepared by quantizing a phase difference distribution for each direction is represented by Equation (4) below.

$$Q(\omega, \theta, n) = \begin{cases} 1, & \text{if } n = \left\lfloor \frac{\phi(\omega, \theta)}{\alpha} \right\rfloor \\ 0, & \text{otherwise} \end{cases} \quad (4)$$

It is noted that a quantization coefficient $\alpha$ is defined as the same value as the quantization coefficient $\alpha$ defined in the quantizer 131. In the present embodiment, the quantization coefficient $\alpha$ is defined as $\pi/5$.

Figure 5A:
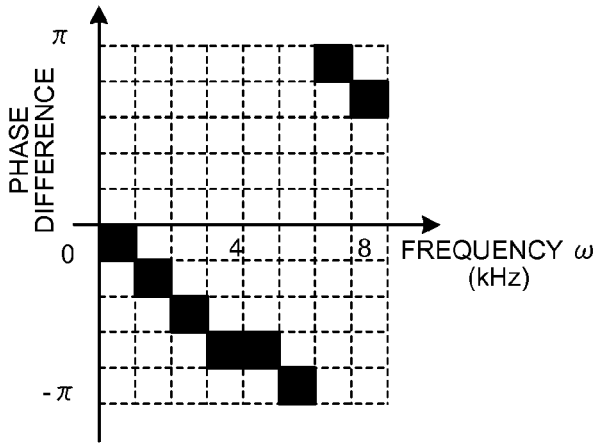
FIGS. 5A to 5C are diagrams each illustrating an example of a template generated by quantizing phase differences distribution for individual directions.
Figure 5B:
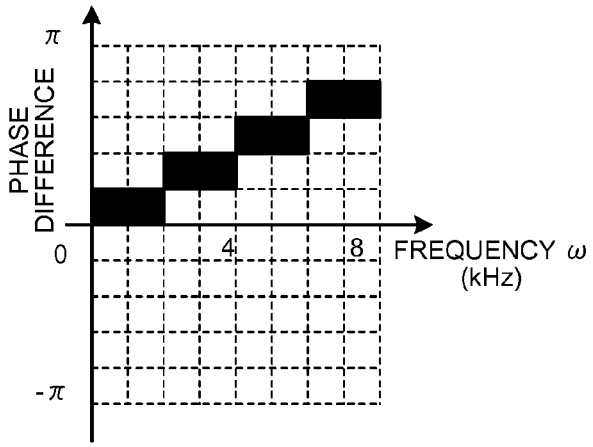
Figure 5C:
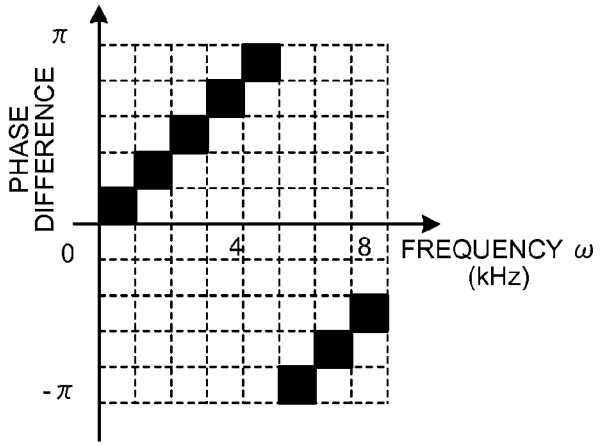

Examples of the templates generated by quantizing the phase difference distributions for individual directions illustrated in FIG. 4 are illustrated in FIGS. 5A to 5C. FIG. 5A indicates an example of a template corresponding to the direction having a direction angle $\theta$ of −60 degrees. FIG. 5B indicates an example of a template corresponding to the direction having a direction angle $\theta$ of 30 degrees. FIG. 5C indicates an example of a template corresponding to the direction having a direction angle $\theta$ of 90 degrees.

Here, in the present embodiment, the quantized phase difference distributions for individual directions are stored as a template in the storage 14, as illustrated in FIGS. 5A to 5C. However, the present invention is not limited thereto. For example, as illustrated in FIG. 4, the phase difference distributions for individual directions may be stored as a template in the storage 14. Then, when a phase difference distribution generated by the generator 12 is quantized by the quantizer 131, the phase difference distributions for individual directions stored as a template in the storage 14 may also be quantized by the quantizer 131.

The score calculator 132 repeats the processing of sequentially reading a template for each direction stored in the storage 14 one by one to compare the phase difference distribution quantized by the quantizer 131 with the template read from the storage 14. Accordingly, a score for each direction is calculated. Specifically, the score calculator 132 calculates the number of frequency bins where the phase differences in the phase difference distribution quantized by the quantizer 131 and in the template to be compared with are identical, as a score in a direction (a direction angle $\theta$) corresponding to the template. A score $\nu(\theta)$ for each direction is calculated by a calculation equation of Equation (5) below.

$$\nu(\theta) = \sum_{\omega} q(\omega, n), \text{ if } Q(\omega, \theta, n) = 1 \quad (5)$$

Figure 6:
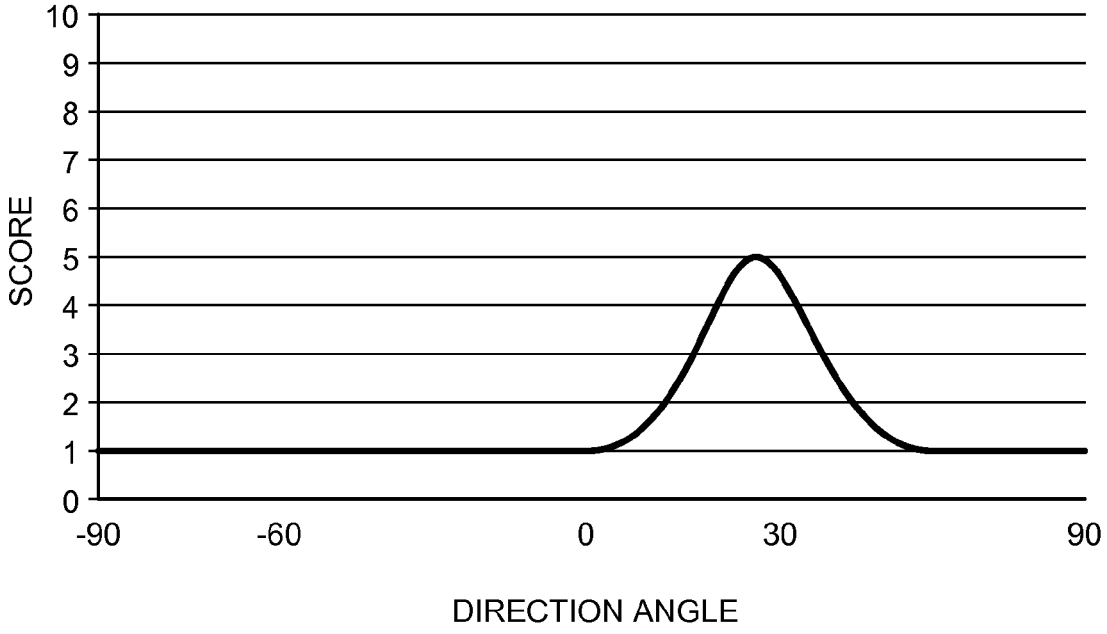
FIG. 6 is a diagram illustrating an example of scored calculated for each direction.

In the present embodiment, the score $\nu(\theta)$ for each direction is calculated by giving an equal partial score to a frequency bin where a quantized phase difference distribution coincides with a template and accumulating these partial scores. An example of the scores for individual directions calculated by comparing the quantized phase difference distribution illustrated in FIG. 3 with the templates illustrated in FIGS. 5A to 5C is illustrated in FIG. 6. FIG. 6 indicates a waveform (hereinafter, referred to as a score waveform) obtained by arranging the scores for individual directions in an order of direction angle and interpolating the arranged scores. The score in a direction having a direction angle of −60 degrees is 1 ($\nu(-60)=1$); the score in a direction having a direction angle of 30 degrees is 5 ($\nu(30)=5$); and the score in a direction having a direction angle of 90 degrees is 1 ($\nu(90)=1$).

The estimator 15 estimates that the direction of a sound source is a direction having high similarity between the phase difference distribution generated by the generator 12 and the template, that is, a direction in which a score calculated by the score calculator 132 is high. The direction of a sound source estimated by the estimator 15 is represented by Equation (6) below.

$$\hat{\theta} = \underset{\theta}{\operatorname{argmax}}\, \nu(\theta) \quad (6)$$

The output unit 16 externally outputs the direction of a sound source estimated by the estimator 15.

Figure 7:
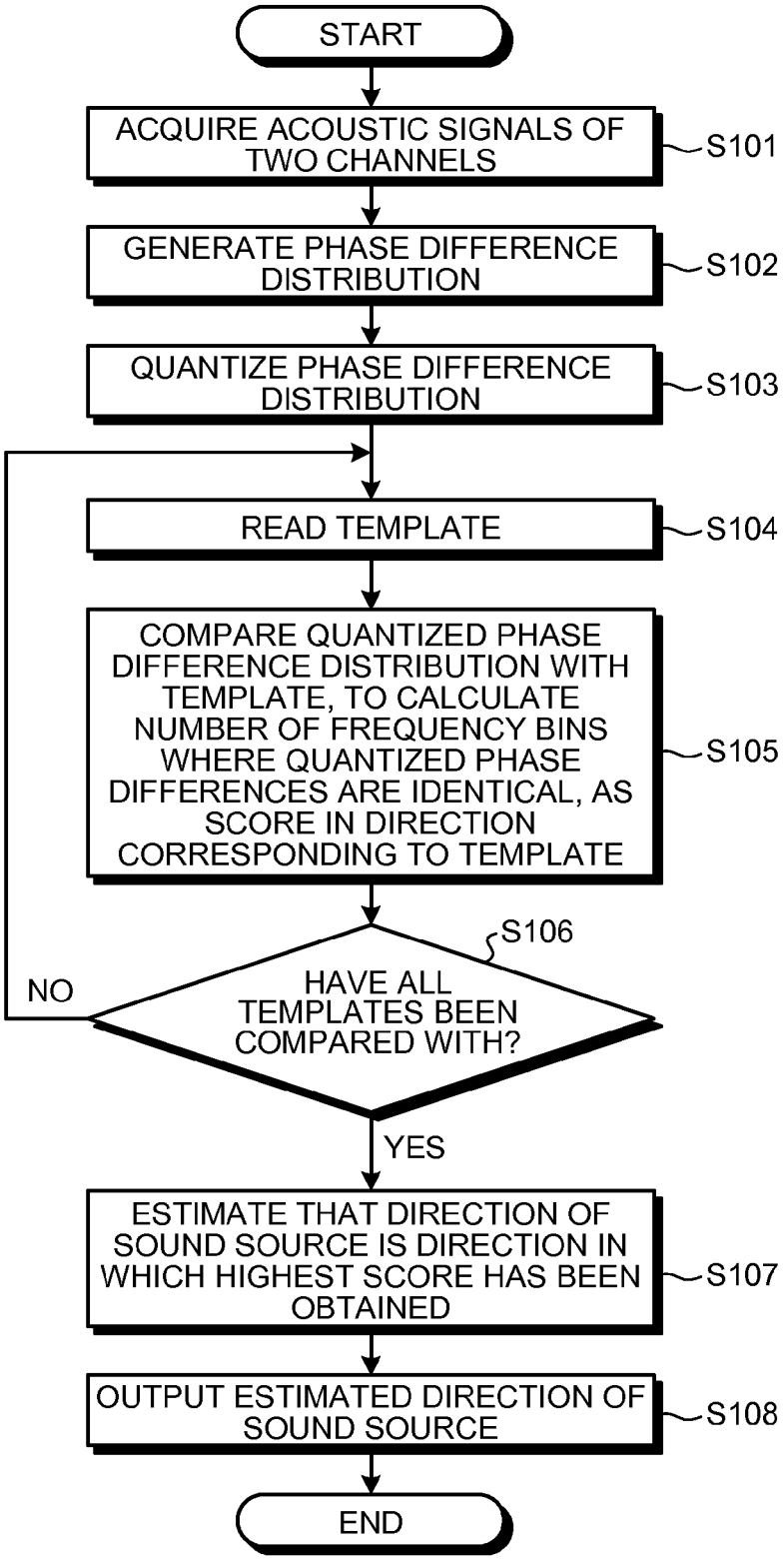
FIG. 7 is a flowchart illustrating an example of a processing procedure by the sound source direction estimation apparatus according to the first embodiment.

FIG. 7 is a flowchart illustrating an example of a processing procedure by the sound source direction estimation apparatus according to the first embodiment. Hereinafter, an operational outline of the sound source direction estimation apparatus according to the first embodiment will be described along the flowchart of FIG. 7.

When the processing illustrated in FIG. 7 starts, the acquisition unit 11 acquires acoustic signals of two channels form two microphones M1 and M2 (step S101).

Next, the generator 12 calculates a phase difference of the acoustic signals of two channels acquired in step S101, for each frequency bin, to generate a phase difference distribution (step S102).

Next, the quantizer 131 quantizes the phase difference distribution generated in step S102 to generate a quantized phase difference distribution (step S103).

Next, the score calculator 132 reads one template to be compared with from the storage 14 (step S104). Then, the score calculator 132 compares the quantized phase difference distribution generated in step S103 with the template read from the storage 14 in step S104, and calculates the number of frequency bins where the quantized phase differences are identical, as a score in a direction corresponding to the template (step S105).

Thereafter, the score calculator 132 determines whether or not the processing of step S105 has been performed for all of the templates stored in the storage 14 to be compared with (step S106). When there is a template that has not been compared with (step S106: No), the procedure returns to step S104 to repeat the processing.

On the other hand, when the processing of step S105 has been performed for all of the templates stored in the storage 14 to be compared with (step S106: Yes), the estimator 15 estimates that the direction of a sound source is a direction in which the highest score is obtained among the scores calculated in step S105 (step S107). Then, the output unit 16 outputs the direction of a sound source estimated in step S107 to the outside of the sound source direction estimation apparatus (step S108), and terminates a series of processing.

As described above by referring to the specific example, the sound source direction estimation apparatus according to the present embodiment compares the phase difference distribution of the acoustic signals of the plurality of channels acquired from the plurality of microphones M1 and M2, with the templates prepared in advance for each direction. Then, the sound source direction estimation apparatus calculates a score in accordance with the similarity between the both for each direction, and estimates the direction of a sound source based on the score. Therefore, according to the sound source direction estimation apparatus according to the present embodiment, estimation of a sound source direction using a phase difference distribution can be performed in a low calculation amount. Consequently, even when hardware resources used for calculation are of low specification, accurate estimation of a sound source direction can be performed in real time.

In particular, the sound source direction estimation apparatus according to the present embodiment quantizes a phase difference distribution of acoustic signals of a plurality of channels, and compares the quantized phase difference distribution with a template for each direction. Then, the sound source direction estimation apparatus calculates the number of frequency bins where the quantized phase differences are identical, as a score in the direction corresponding to the template to be compared with. For this reason, the calculation amount needed for score calculation is extremely low.

Second Embodiment

Next, a second embodiment will be described. In the first embodiment described above, a score for each direction is calculated by giving an equal partial score to a frequency bin where the quantized phase difference distribution coincides with the template and accumulating these partial scores. However, the performance of microphones M1 and M2, noise, reverberation and the like sometimes cause an outlier to be generated in the phase difference distribution. This outlier may have an adverse effect on the estimation of a sound source direction. To address this concern, in the present embodiment, an additional score is set for each frequency bin so as to calculate the sum of the additional scores set for individual frequency bins where the quantized phase difference distribution coincides with the template, as a score in a direction corresponding to the template to be compared with. Thus, the influence of an outlier is inhibited.

Hereinafter, portions characteristic of the present embodiment will be described while appropriately omitting the redundant description of the constituents common to those in the first embodiment by assigning the same reference numerals in the drawings.

Figure 8:
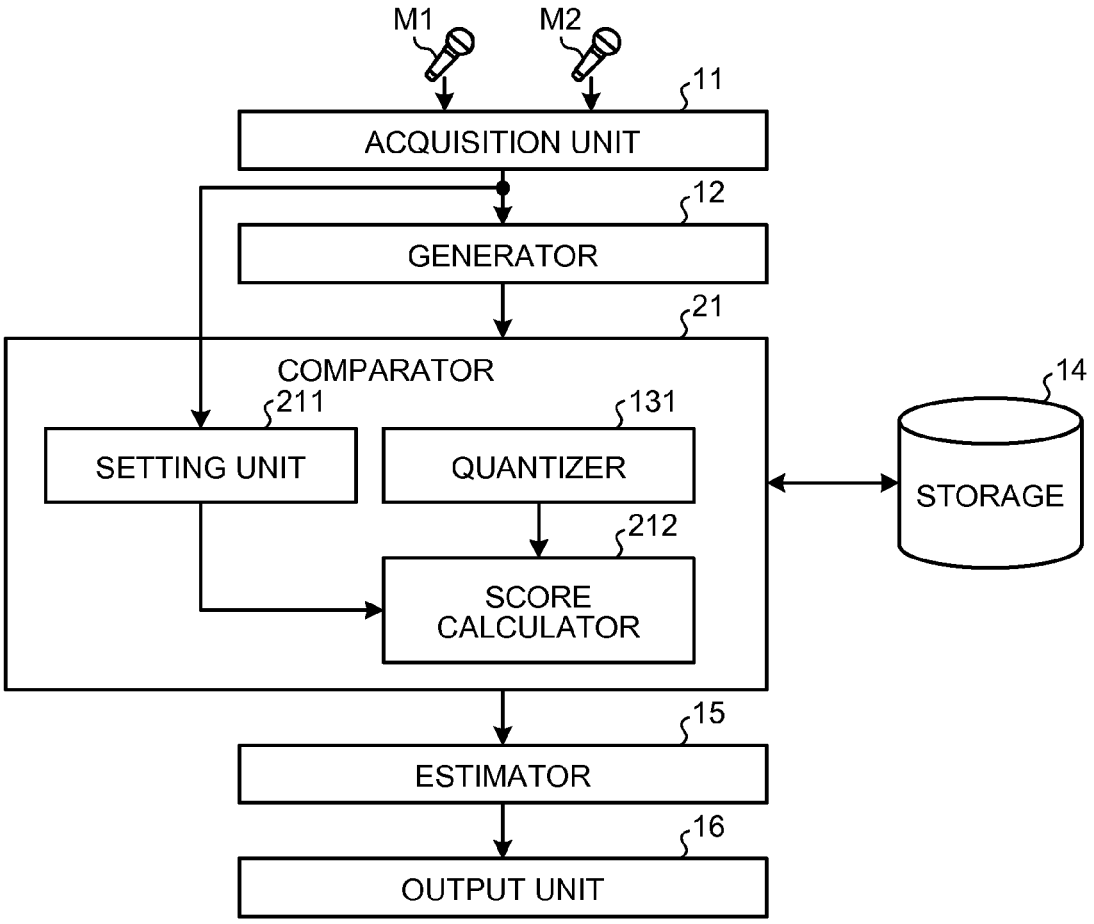
FIG. 8 is a block diagram illustrating a functional configuration example of a sound source direction estimation apparatus according to a second embodiment.

FIG. 8 is a block diagram illustrating a functional configuration example of a sound source direction estimation apparatus according to a second embodiment. The sound source direction estimation apparatus according to the present embodiment includes, as illustrated in FIG. 8, a comparator 21 in place of the comparator 13 according to the first embodiment. Except for that point, the configuration is similar to that in the first embodiment. The comparator 21 includes the quantizer 131 similar to that in the first embodiment, a setting unit 211, and a score calculator 212.

The setting unit 211 sets an additional score for each frequency bin for which the generator 12 calculates a phase difference, based on the acoustic signals of two channels acquired by the acquisition unit 11. The additional score is set such that the value of the additional score is higher as the possibility that the phase difference in the frequency bin is an outlier is lower.

Specifically, for example, a value corresponding to the magnitude of a log power of an acoustic signal in each frequency bin, such as a value of a log power itself, or a value proportional to the value of a log power, may be set as an additional score for each frequency bin. Alternatively, a value corresponding to the magnitude of a signal/noise ratio (an S/N ratio) of an acoustic signal in each frequency bin, such as a value of an S/N ratio itself, or a value proportional to the S/N ratio, may be set as an additional score for each frequency bin.

The score calculator 212, similarly to the score calculator 132 according to the first embodiment, repeats the processing of sequentially reading a template for each direction stored in the storage 14 one by one to compare the phase difference distribution quantized by the quantizer 131 with the template read from the storage 14. Accordingly, a score for each direction is calculated. However, the score calculator 212 according to the present embodiment calculates the sum of the additional scores set by the setting unit 211 for individual frequency bins where the phase differences in the phase difference distribution quantized by the quantizer 131 and in the template to be compared with are identical, as a score in a direction corresponding to the template.

Figure 9:
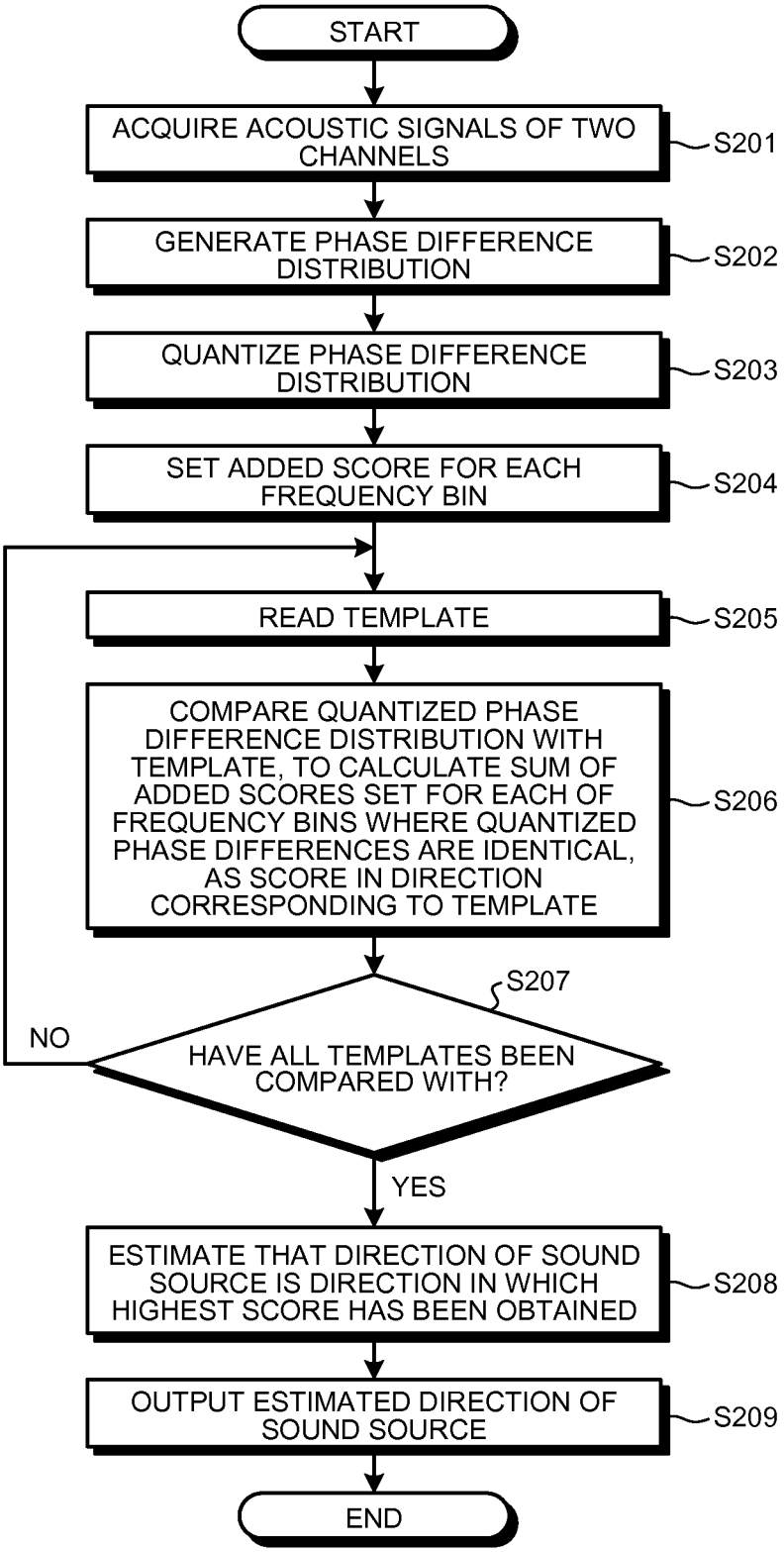
FIG. 9 is a flowchart illustrating an example of a processing procedure by the sound source direction estimation apparatus according to the second embodiment.

FIG. 9 is a flowchart illustrating an example of a processing procedure by the sound source direction estimation apparatus according to the second embodiment. Hereinafter, an operational outline of the sound source direction estimation apparatus according to the second embodiment will be described along the flowchart of FIG. 9.

Since the processing from step S201 to step S203 in FIG. 9 is similar to the processing from step S101 to step S103 illustrated in FIG. 7, the description thereof will be omitted.

In the present embodiment, after the quantized phase difference distribution is generated in step S203, the setting unit 211 sets additional scores for individual frequency bins, based on the acoustic signals acquired in step S201 (step S204). It is noted that this processing of step S204 may be performed before or in parallel to the processing of step S202 and step S203.

Next, the score calculator 212 reads one template to be compared with from the storage 14 (step S205). Then, the score calculator 212 compares the quantized phase difference distribution generated in step S203 with the template read from the storage 14 in step S205, and calculates the sum of the additional scores set in step S204 for the frequency bins where the quantized phase differences are identical, as a score for a direction corresponding to the template (step S206).

Since the processing from step S207 to step S209 in FIG. 9 is similar to the processing from step S106 to step S108 illustrated in FIG. 7, the description thereof will be omitted.

As described above, the sound source direction estimation apparatus according to the present embodiment sets additional scores for individual frequency bins based on the acoustic signals acquired from the microphones M1 and M2, and calculates the sum of the additional scores set for individual frequency bins where the quantized phase difference distribution coincides with the template, as a score in a direction corresponding to the template to be compared with. Therefore, according to the sound source direction estimation apparatus of the present embodiment, the influence of an outlier in a phase difference distribution can be effectively inhibited. Thus, estimation of a sound source direction can be performed more accurately than in the first embodiment.

Third Embodiment

Next, a third embodiment will be described. In the first embodiment described above, all of the templates for individual directions stored in the storage 14 are sequentially read as a comparison target to the quantized phase difference distribution for performing the processing. However, when the angle resolution requested by a user is lower with respect to the angle resolution for a direction at which templates have been prepared in advance, it is not necessary to perform the processing using all the templates as a comparison target. Therefore, in the present embodiment, designation of an angle resolution by a user is accepted, and templates are selected in a number corresponding to the designated angle resolution for performing processing, in order to further reduce a calculation amount.

Hereinafter, portions characteristic of the present embodiment will be described while appropriately omitting the redundant description of the constituents common to those in the first embodiment by assigning the same reference numerals in the drawings. It is noted that while an example of performing score calculation in a similar method to that in the first embodiment will be described below, the score calculation may be performed in a similar method to that in the second embodiment.

Figure 10:
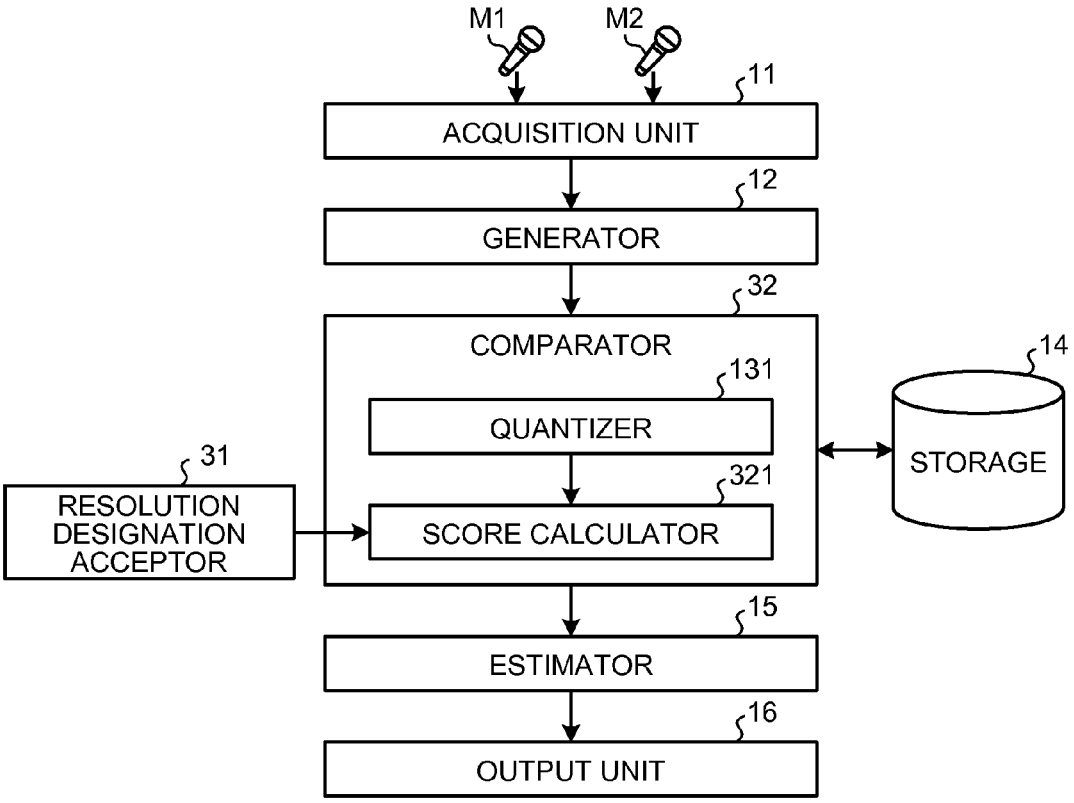
FIG. 10 is a block diagram illustrating a functional configuration example of a sound source direction estimation apparatus according to a third embodiment.

FIG. 10 is a block diagram illustrating a functional configuration example of a sound source direction estimation apparatus according to the third embodiment. The sound source direction estimation apparatus according to the present embodiment includes, as illustrated in FIG. 10, a resolution designation acceptor 31 in addition to the configuration in the first embodiment. Furthermore, the sound source direction estimation apparatus according to the present embodiment includes a comparator 32 in place of the comparator 13 according to the first embodiment. Except for that point, the configuration is similar to that in the first embodiment. The comparator 32 includes the quantizer 131 similar to that in the first embodiment, and a score calculator 321.

The resolution designation acceptor 31 accepts the designation of an angle resolution by a user. The angle resolution represents the degree of fineness at which the direction of a sound source is estimated. The angle resolution may be designated with numerical values, or may be selected from predetermined angle resolutions, in a manner of, for example, 5 degrees, 10 degrees, 15 degrees and so on.

The score calculator 321 selects templates in a number corresponding to the angle resolution designated by a user, among the templates for individual directions stored in the storage 14, as a comparison target to the phase difference distribution quantized by the quantizer 131. For example, in a case where the angle resolution designated by a user is 10 degrees when templates for each 1 degree of direction angle are stored in the storage 14, the score calculator 321 selects, as a comparison target, a template for each 10 degrees in direction angle, that is, templates in a number of 1/10, from the templates stored in the storage 14.

Then, the score calculator 321 repeats the processing of sequentially reading the templates selected as a comparison target one by one from the storage 14 to compare the phase difference distribution quantized by the quantizer 131 with the template read from the storage 14. Thus, a score for each direction corresponding to the angle resolution designated by a user is calculated. It is noted that the method of score calculation is similar to that in the score calculator 132 according to the first embodiment.

Figure 11:
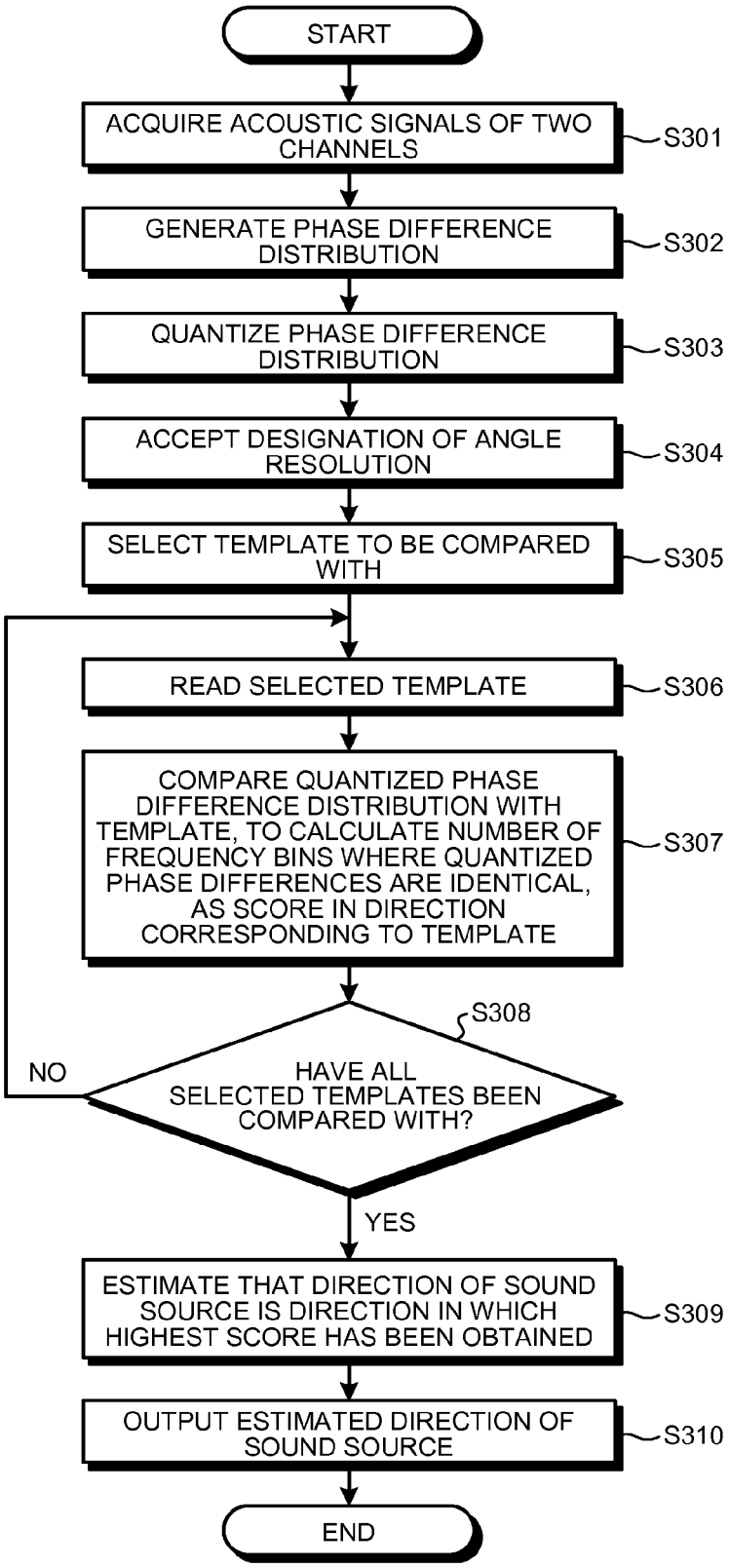
FIG. 11 is a flowchart illustrating an example of a processing procedure by the sound source direction estimation apparatus according to the third embodiment.

FIG. 11 is a flowchart illustrating an example of a processing procedure by the sound source direction estimation apparatus according to the third embodiment. Hereinafter, an operational outline of the sound source direction estimation apparatus according to the third embodiment will be described along the flowchart of FIG. 11.

Since the processing from step S301 to step S303 in FIG. 11 is similar to the processing from step S101 to step S103 illustrated in FIG. 7, the description thereof will be omitted.

In the present embodiment, after the quantized phase difference distribution is generated in step S303, the resolution designation acceptor 31 accepts the designation of an angle resolution by a user (step S304). It is noted that this processing of step S304 may be performed before or in parallel to the processing of any of step S301 to step S303.

Next, the score calculator 321 selects templates to be compared with, among the templates for individual directions stored in the storage 14, in accordance with the angle resolution designated in step S304 (step S305). Then, the score calculator 321 reads one of the templates selected in step S305 from the storage 14 (step S306), and compares the quantized phase difference distribution generated in step S303 with the template read from the storage 14 in step S306, to calculate the number of frequency bins where the quantized phase differences are identical, as a score for a direction corresponding to the template (step S307).

Thereafter, the score calculator 321 determines whether or not the processing of step S307 has been performed for all of the templates selected in S305 as a comparison target (step S308). When there is a template that has not been compared with (step S308: No), the score calculator 321 returns to step S306 to repeat the processing.

On the other hand, when the processing of step S307 has been performed for all of the templates selected in step S305 as a comparison target (step S308: Yes), the estimator 15 estimates that the direction of a sound source is a direction in which the highest score is obtained among the scores calculated in step S307 (step S309). Then, the output unit 16 outputs the direction of a sound source estimated in step S309 to the outside of the sound source direction estimation apparatus (step S310), and terminates a series of processing.

As described above, the sound source direction estimation apparatus according to the present embodiment selects templates to be compared with in accordance with the angle resolution designated by a user, and compares the quantized phase difference distribution with each of the selected templates to calculate a score for each direction corresponding to the designated angle resolution. Therefore, according to the sound source direction estimation apparatus according to the present embodiment, a calculation amount required for the estimation of a sound source direction can be further reduced compared to that in the first embodiment.

Fourth Embodiment

Next, a fourth embodiment will be described. In the first embodiment described above, based on an assumption that the number of sound sources is one when the estimator 15 estimates the direction of a sound source, the direction of a sound source is estimated to be a direction in which the highest score is obtained in the processing in the comparator 13. However, a sound is sometimes simultaneously emitted from a plurality of sound sources in a practical sense. To address this concern, the fourth embodiment is configured that designation of the number of sound sources by a user is accepted to estimate directions of the designated number of sound sources.

Hereinafter, portions characteristic of the present embodiment will be described while appropriately omitting the redundant description of the constituents common to those in the first embodiment by assigning the same reference numerals in the drawings. It is noted that while an example of performing score calculation in a similar method to that in the first embodiment will be described below, the score calculation may be performed in a similar method to that in the second embodiment or the third embodiment.

Figure 12:
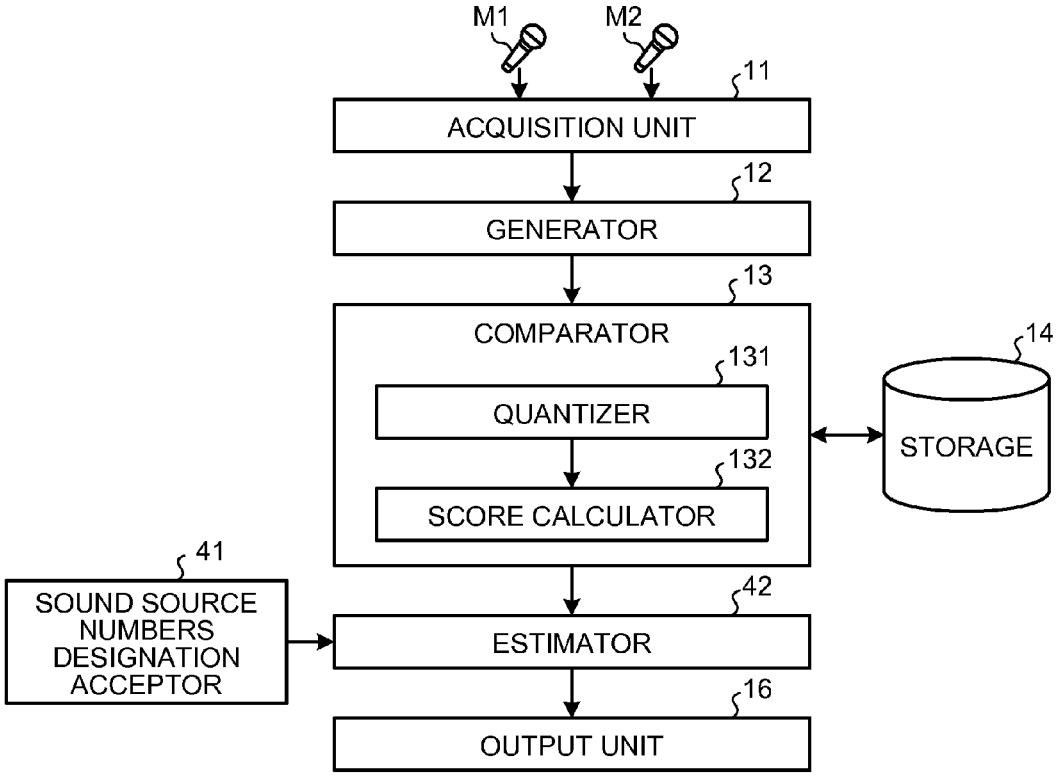
FIG. 12 is a block diagram illustrating a functional configuration example of a sound source direction estimation apparatus according to a fourth embodiment.

FIG. 12 is a block diagram illustrating a functional configuration example of the sound source direction estimation apparatus according to the fourth embodiment. The sound source direction estimation apparatus according to the present embodiment includes, as illustrated in FIG. 12, a sound source numbers designation acceptor 41 in addition to the configuration in the first embodiment. Furthermore, the sound source direction estimation apparatus according to the present embodiment includes an estimator 42 in place of the estimator 15 according to the first embodiment. Except for that point, the configuration is similar to that in the first embodiment.

The sound source numbers designation acceptor 41 accepts the designation of the number of sound sources by a user. The number of sound sources designated by a user, which has been accepted by the sound source numbers designation acceptor 41, is delivered to the estimator 42.

The estimator 42 generates a waveform by arranging the scores for individual directions calculated by the score calculator 132 of the comparator 13 in an order of direction angle and interpolating the arranged scores, and detects local maximum values of this score waveform. Then, the estimator 42 selects local maximum values in a number equal to the number of sound sources designated by a user in a descending order of score, among the local maximum values detected from the score waveform, and estimates that the directions of sound sources are directions corresponding to the selected local maximum values.

Figure 13:
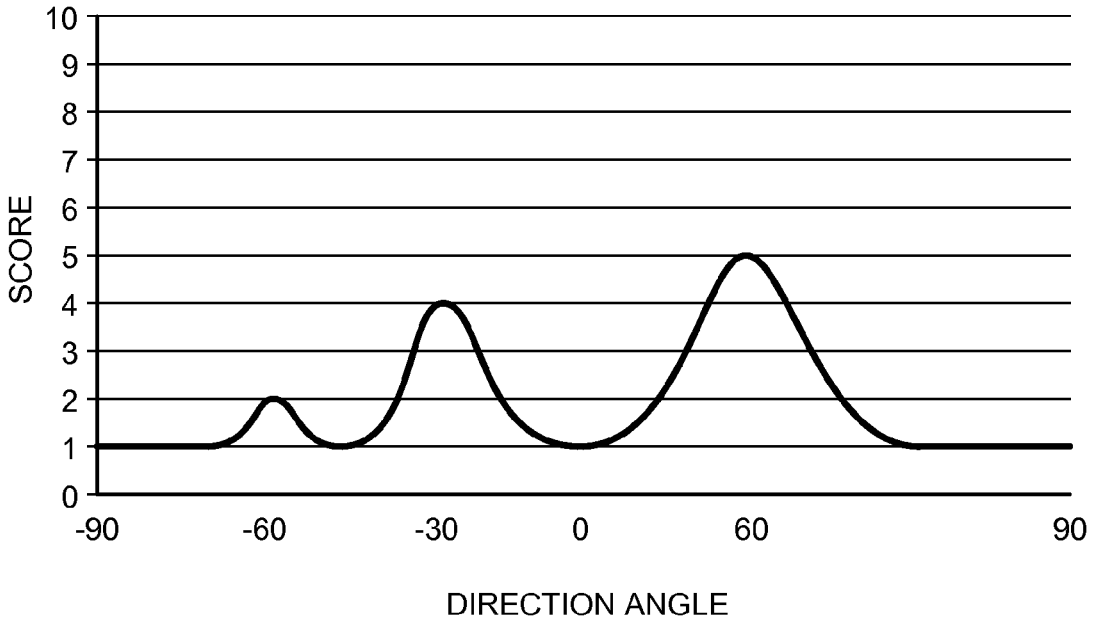
FIG. 13 is a diagram illustrating an example of a score waveform.

FIG. 13 is a diagram illustrating an example of the score waveform generated by the estimator 42. In the score waveform illustrated in FIG. 13, local maximum values exist at locations of direction angles of −60 degrees, −30 degrees and 60 degrees. Here, when the number of sound sources designated by a user is two, the estimator 42 selects, among these three local maximum values, two local maximum values in a descending order of score, that is, a local maximum value at the location of a direction angle of 60 degrees and a local maximum value at the location of a direction angle of −30 degrees. Then, the estimator 42 estimates that the directions of sound sources are directions corresponding to these selected two local maximum values, that is, a direction having a direction angle of 60 degrees and a direction having a direction angle of −30 degrees.

Figure 14:
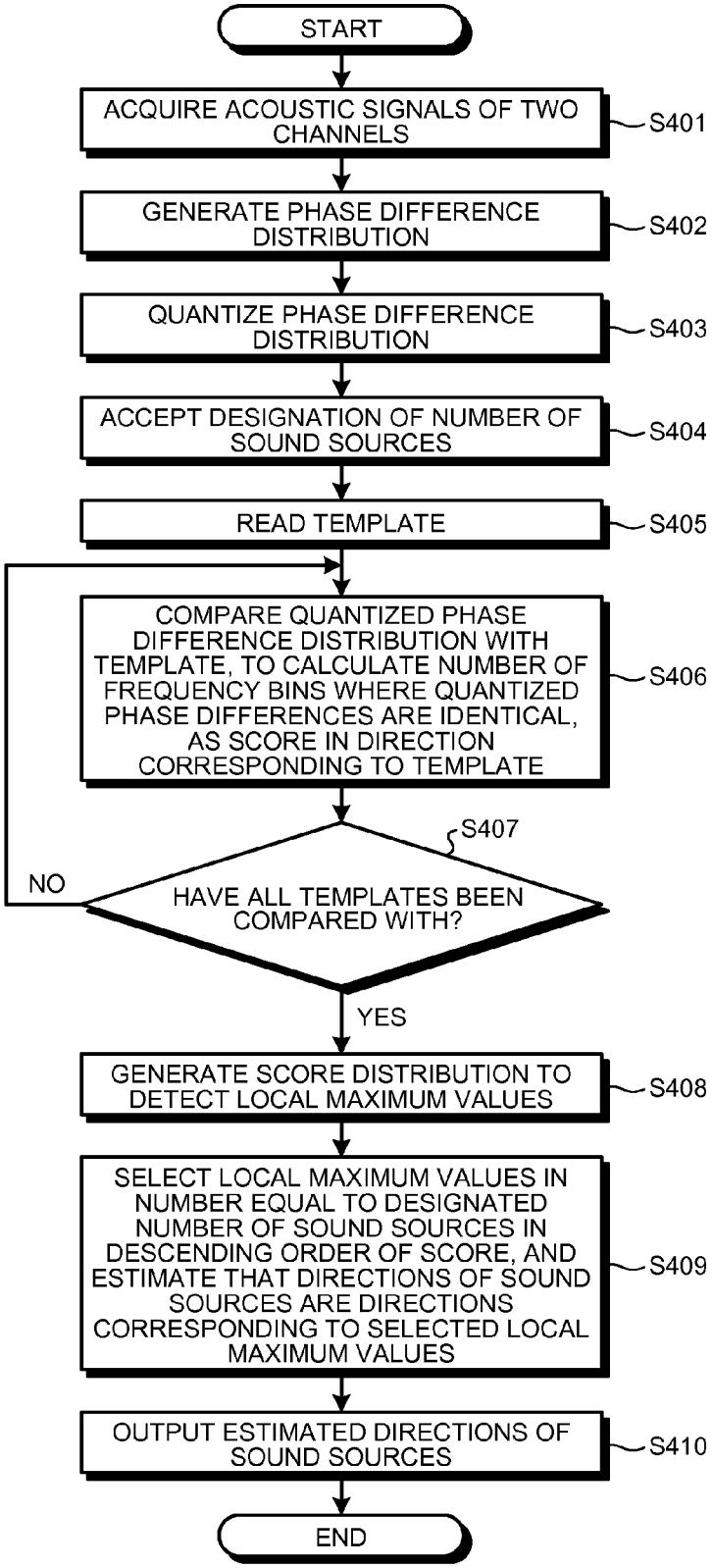
FIG. 14 is a flowchart illustrating an example of a processing procedure by the sound source direction estimation apparatus according to the fourth embodiment.

FIG. 14 is a flowchart illustrating an example of a processing procedure by the sound source direction estimation apparatus according to the fourth embodiment. Hereinafter, an operational outline of the sound source direction estimation apparatus according to the fourth embodiment will be described along the flowchart of FIG. 14.

Since the processing from step S401 to step S403 in FIG. 14 is similar to the processing from step S101 to step S103 illustrated in FIG. 7, the description thereof will be omitted.

In the present embodiment, after the quantized phase difference distribution is generated in step S403, the sound source numbers designation acceptor 41 accepts the designation of the number of sound sources by a user (step S404). It is noted that this processing of step S404 may be performed before or in parallel to the processing of any of step S401 to step S403. Also, this processing of step S404 may be performed after or in parallel to the processing of any of step S405 to step S408 described later, as long as the processing of step S404 is performed before the processing of step S409 described later.

Since the processing from step S405 to step S407 in FIG. 14 is similar to the processing from step S104 to step S106 illustrated in FIG. 7, the description thereof will be omitted.

In the present embodiment, when it is determined in step S407 that the processing of step S406 has been performed for all of the templates stored in the storage 14 as a comparison target (step S407: Yes), the estimator 42 generates a score waveform by arranging the scores calculated in step S406 in an order of direction angle and interpolating the arranged scores, and detects local maximum values of the score waveform (step S408). Then, the estimator 42 selects local maximum values in a number equal to the number of sound sources designated in step S404, among the detected local maximum values, and estimates that the directions of sound sources are directions corresponding to the selected local maximum values (step S409). Then, the output unit 16 outputs the directions of sound sources estimated in step S409 to the outside of the sound source direction estimation apparatus (step S410), and terminates a series of processing.

As described above, the sound source direction estimation apparatus according to the present embodiment generates a score waveform from scores for individual directions to detect local maximum values, and selects local maximum values in a number equal to the number of sound sources designated by a user in a descending order of score among the detected local maximum values, and estimates that the directions of sound sources are directions corresponding to the selected local maximum values. Therefore, according to the sound source direction estimation apparatus of the present embodiment, even when a sound is simultaneously emitted from a plurality of sound sources, the directions of these sound sources can be accurately estimated in a small calculation amount.

Fifth Embodiment

Next, a fifth embodiment will be described. The fifth embodiment is to estimate a plurality of directions of sound sources as in the fourth embodiment described above, but the plurality of directions of sound sources are estimated without accepting the designation of the number of sound sources from a user.

Hereinafter, portions characteristic of the present embodiment will be described while appropriately omitting the redundant description of the constituents common to those in the first embodiment by assigning the same reference numerals in the drawings. It is noted that while an example of performing score calculation in a similar method to that in the first embodiment will be described below, the score calculation may be performed in a similar method to that in the second embodiment or the third embodiment.

Figure 15:
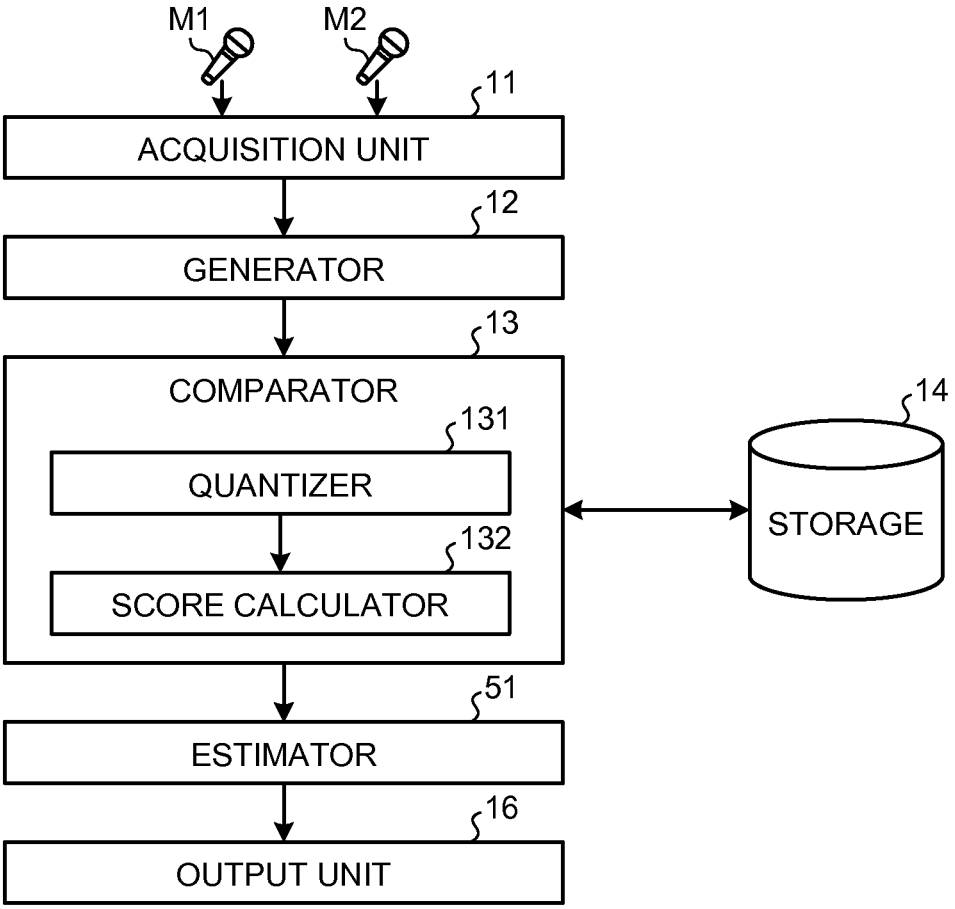
FIG. 15 is a block diagram illustrating a functional configuration example of a sound source direction estimation apparatus according to a fifth embodiment.

FIG. 15 is a block diagram illustrating a functional configuration example of the sound source direction estimation apparatus according to the fifth embodiment. The sound source direction estimation apparatus according to the present embodiment includes, as illustrated in FIG. 15, an estimator 51 in place of the estimator 15 according to the first embodiment. Except for that point, the configuration is similar to that in the first embodiment.

The estimator 51 generates, similarly to the estimator 42 according to the fourth embodiment, a waveform by arranging the scores for individual directions calculated by the score calculator 132 of the comparator 13 in an order of direction angle and interpolating the arranged scores, and detects local maximum values of this score waveform. However, the estimator 51 according to the present embodiment selects local maximum values having scores equal to or higher than a predetermined threshold value, among the local maximum values detected from the score waveform, and estimates that the directions of sound sources are directions corresponding to the selected local maximum values.

Figure 16:
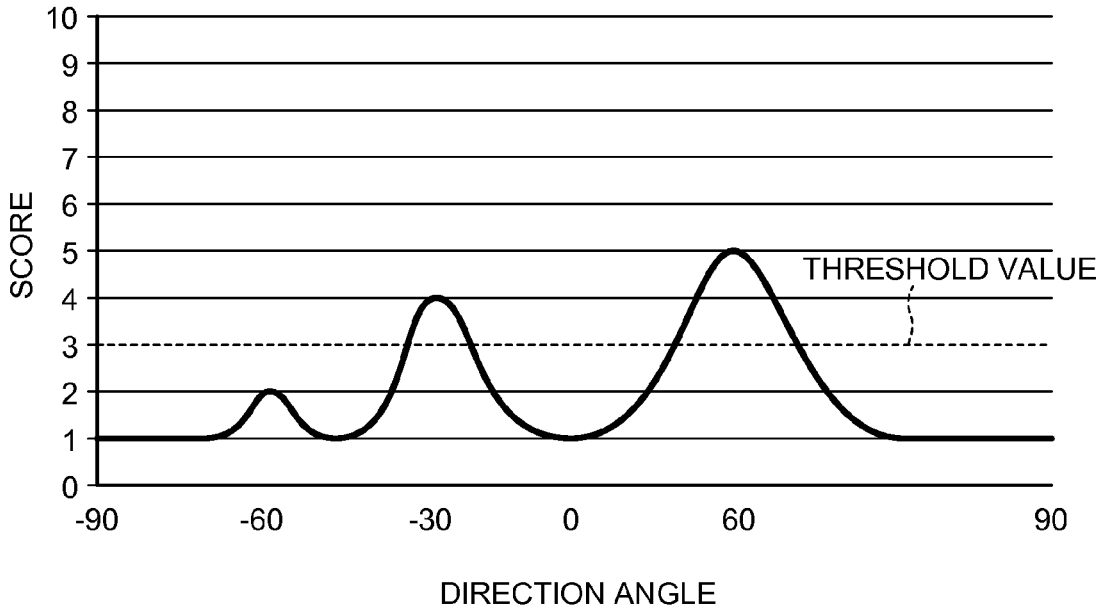
FIG. 16 is a diagram illustrating an example of a score waveform.

FIG. 16 is a diagram illustrating an example of the score waveform generated by the estimator 51. In the score waveform illustrated in FIG. 16, local maximum values exist at locations of direction angles of −60 degrees, −30 degrees and 60 degrees. Here, when 3 is set as a threshold value for a score, the estimator 51 selects, among these three local maximum values, local maximum values having a score of 3 or more, that is, a local maximum value at the location of a direction angle of 60 degrees and a local maximum value at the location of a direction angle of −30 degrees. Then, the estimator 51 estimates that the directions of sound sources are directions corresponding to these selected two local maximum values, that is, a direction having a direction angle of 60 degrees and a direction having a direction angle of −30 degrees.

Figure 17:
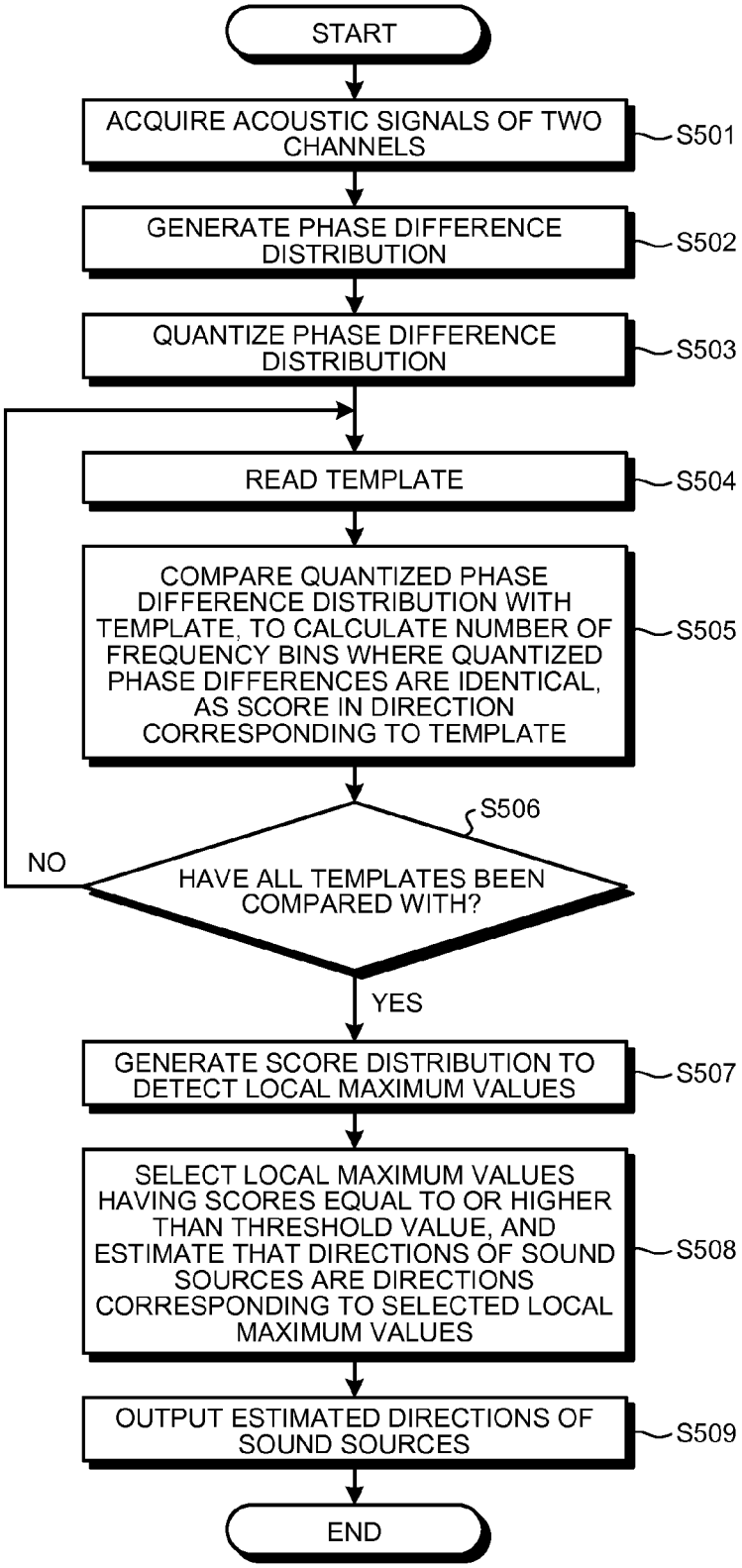
FIG. 17 is a flowchart illustrating an example of a processing procedure by the sound source direction estimation apparatus according to the fifth embodiment.

FIG. 17 is a flowchart illustrating an example of a processing procedure by the sound source direction estimation apparatus according to the fifth embodiment. Hereinafter, an operational outline of the sound source direction estimation apparatus according to the fifth embodiment will be described along the flowchart of FIG. 17.

Since the processing from step S501 to step S506 in FIG. 17 is similar to the processing from step S101 to step S106 illustrated in FIG. 7, the description thereof will be omitted.

In the present embodiment, when it is determined in step S506 that the processing of step S505 has been performed for all of the templates stored in the storage 14 as a comparison target (step S506: Yes), the estimator 51 generates a score waveform by arranging the scores calculated in step S505 in an order of direction angle and interpolating the arranged scores, and detects local maximum values of the score waveform (step S507). Then, the estimator 42 selects local maximum values having scores equal to or higher than a predetermined threshold value among the detected local maximum values, and estimates that the directions of sound sources are directions corresponding to the selected local maximum values (step S508). Then, the output unit 16 outputs the directions of sound sources estimated in step S508 to the outside of the sound source direction estimation apparatus (step S509), and terminates a series of processing.

As described above, the sound source direction estimation apparatus according to the present embodiment generates a score waveform from scores for individual directions to detect local maximum values, and selects local maximum values having scores equal to or higher than the threshold value among the detected local maximum values, and estimates that the directions of sound sources are the directions corresponding to the selected local maximum values. Therefore, according to the sound source direction estimation apparatus of the present embodiment, even when a sound is simultaneously emitted from a plurality of sound sources, the directions of these sound sources can be accurately estimated in a small calculation amount.

Variation

Figure 18:
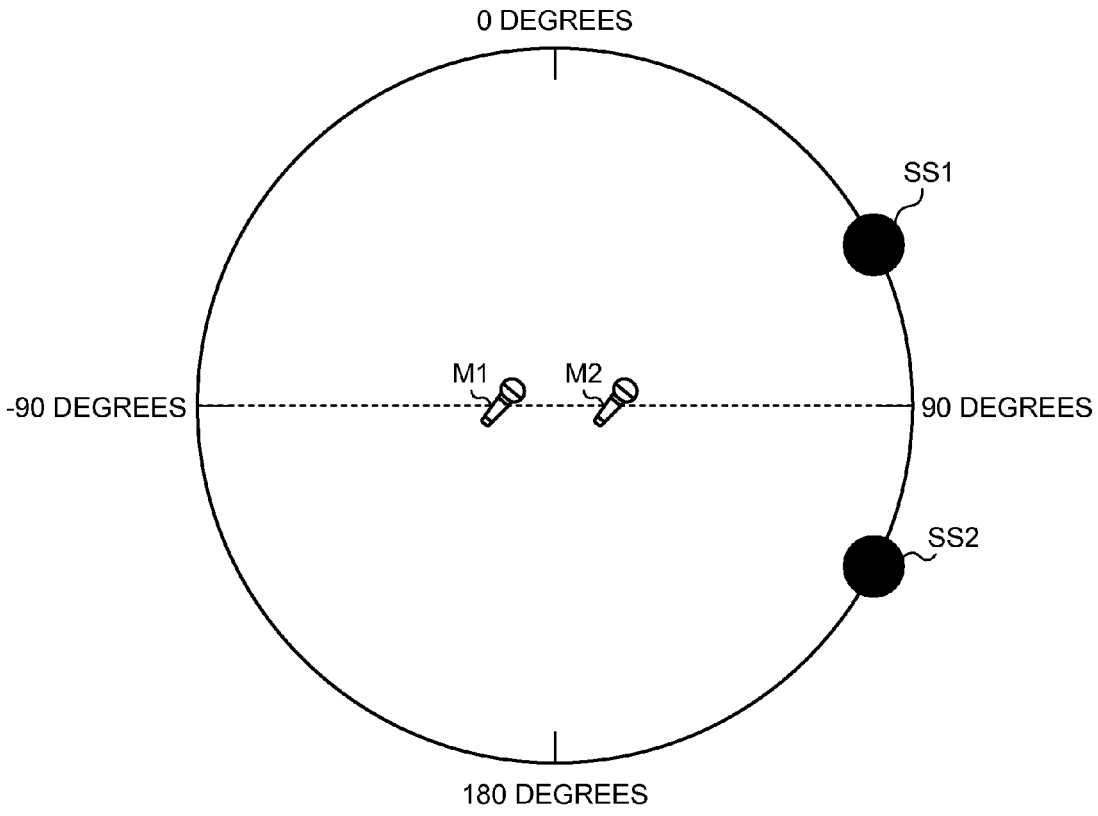
FIG. 18 is a diagram explaining an example where directions of sound sources cannot be distinguished.

Next, a variation of the above-described embodiments will be described. In the embodiments described above, acoustic signals of two channels are acquired from two microphones M1 and M2, to generate a phase difference distribution. In this example, when individual sound sources are present at locations symmetric with respect to a line connecting the locations of two microphones M1 and M2, the phase difference distributions generated from the acoustic signals of the individual sound sources are identical. Therefore, it is impossible to distinguish the directions of sound sources. For example, in an example illustrated in FIG. 18, the phase difference distribution generated from the acoustic signals of a sound source SS1 at the location of a direction angle of 60 degrees is the same as the phase difference distribution generated from the acoustic signals of a sound source SS2 at the location of a direction angle of 120 degrees. Therefore, it is impossible to uniquely determine whether the direction of the sound source is 60 degrees or 120 degrees. For this reason, in the above-described embodiments, the angle range for estimating the direction of a sound source is limited to not less than −90 degrees and not more than 90 degrees.

However, by increasing the number of microphones for acquiring acoustic signals, the angle range for estimating the direction of a sound source can be expanded. Hereinafter, there will be described a variation in which acoustic signals of three channels are acquired using three microphones to accumulate scores obtained from the acoustic signals of two channels of these three channels, so that the sound source direction is estimated within an angle range of 360 degrees (in an omnidirection on the same plane).

Figure 19:
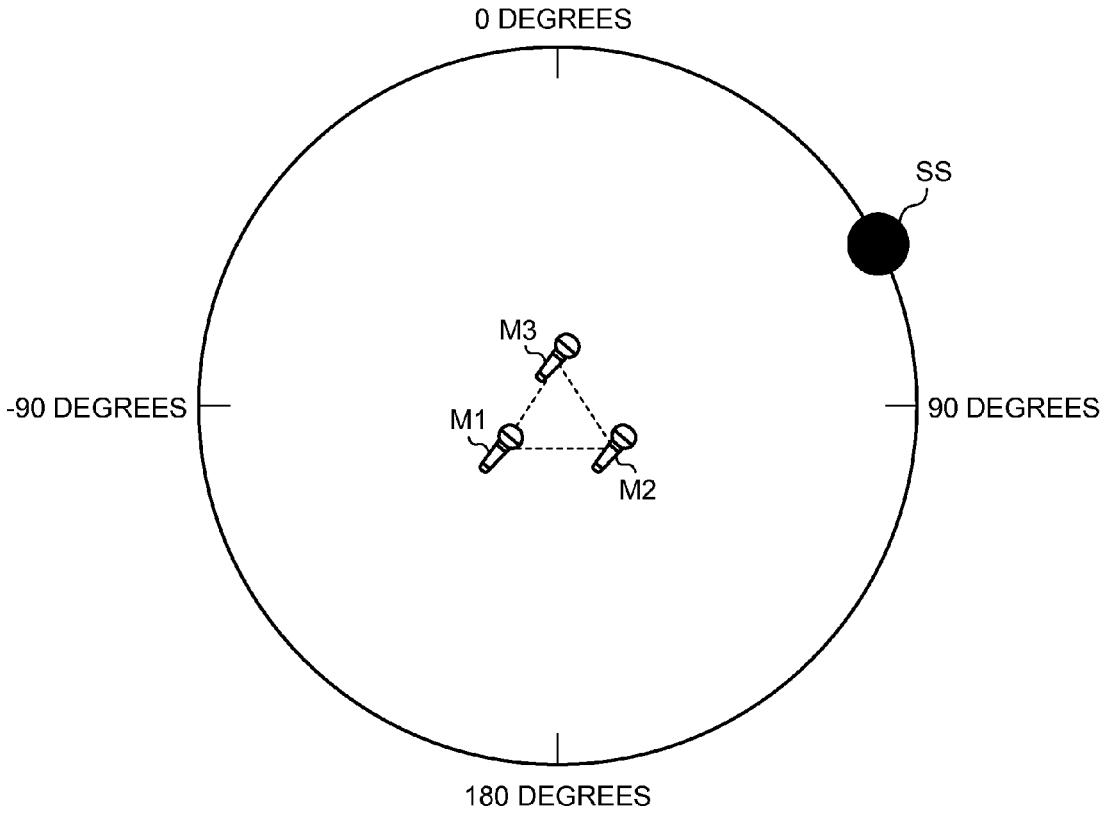
FIG. 19 is a diagram illustrating an example of an arrangement of microphones in a variation.

An example of the arrangement of microphones in the present variation is illustrated in FIG. 19. In the present variation, it is assumed that three microphones M1, M2 and M3 are arranged in the positional relationship illustrated in FIG. 19. Also, a sound source SS is assumed to be located in the direction of a direction angle of 60 degrees.

Figure 20:
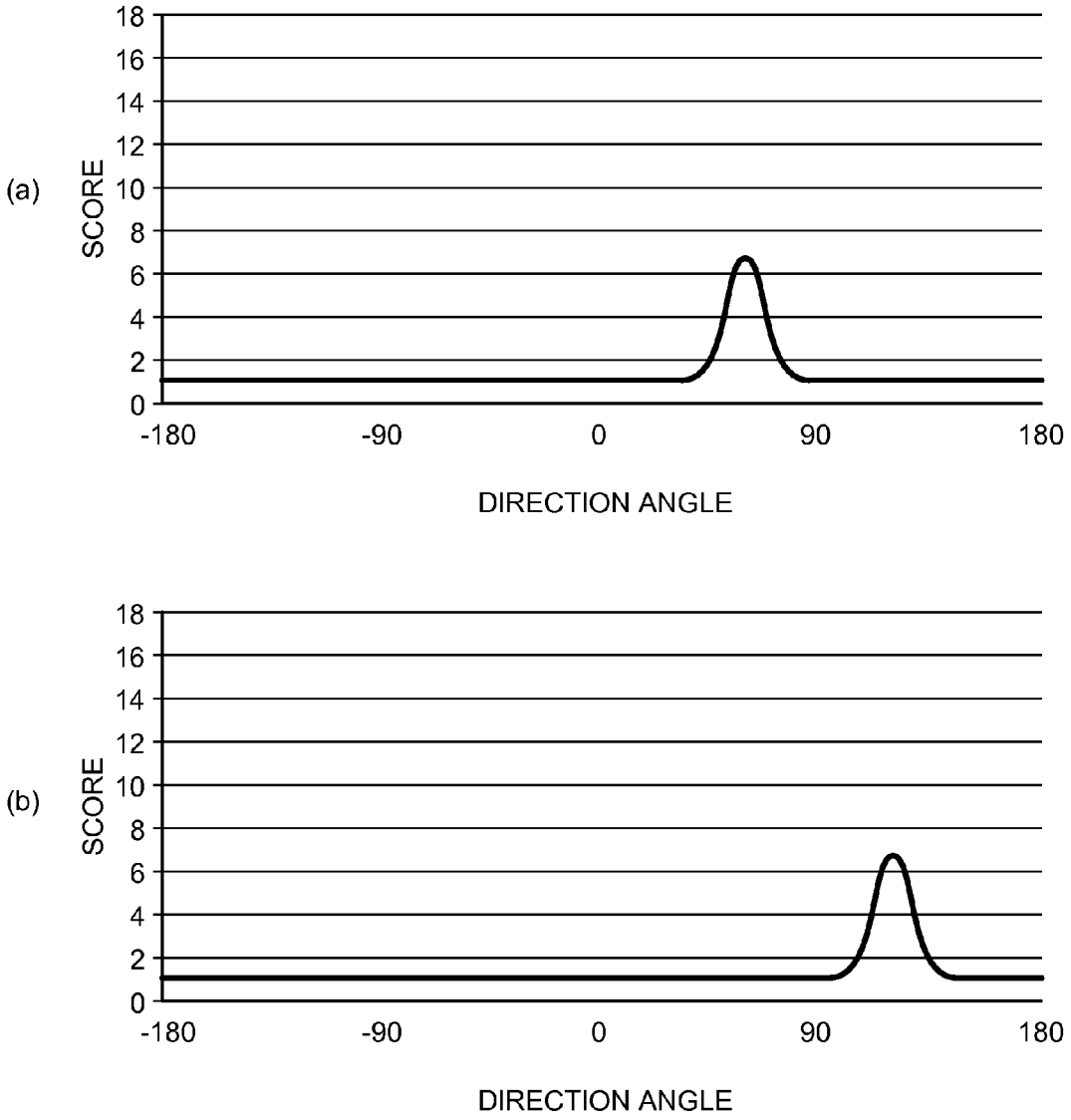
FIG. 20 illustrates examples of omnidirectional scores converted from scores.

First, by performing the processing similar to that in the first embodiment for the acoustic signals of two channels acquired from two microphones M1 and M2, there can be obtained scores for individual directions (a score waveform similar to that in FIG. 6) within an angle range of not less than −90 degrees and not more than 90 degrees. In the present variation, scores obtained in this manner are converted into scores (omnidirectional scores) within an angle range of −180 degrees to 180 degrees, in consideration of the arrangement of the microphone M1 and the microphone M2. In this case, since two direction candidates exist at locations symmetric with respect to a line connecting the microphone M1 and the microphone M2, the obtained omnidirectional scores include first candidate scores illustrated in (a) in FIG. 20 and second candidate scores illustrated in (b) in FIG. 20.

Figure 21:
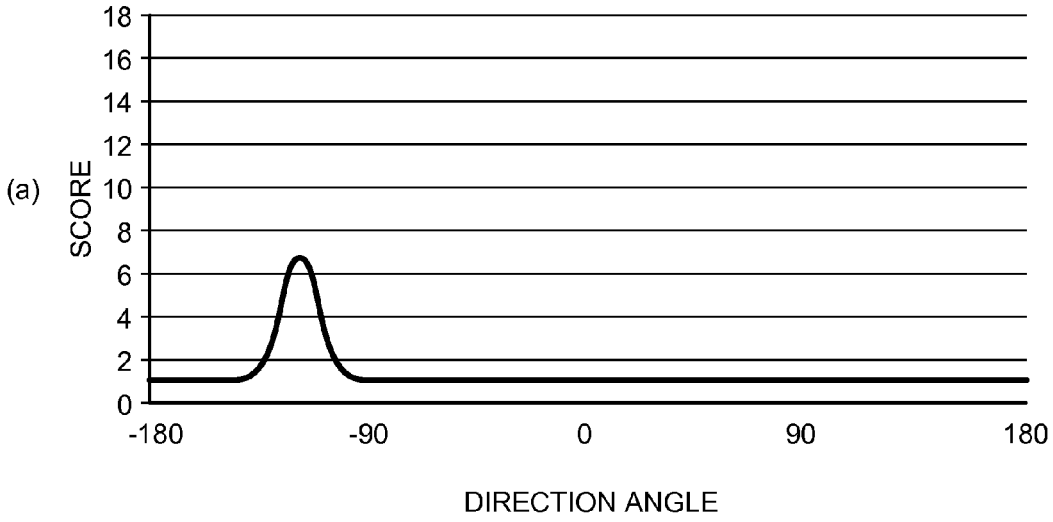
FIG. 21 illustrates examples of omnidirectional scores converted from scores.
Figure 21:
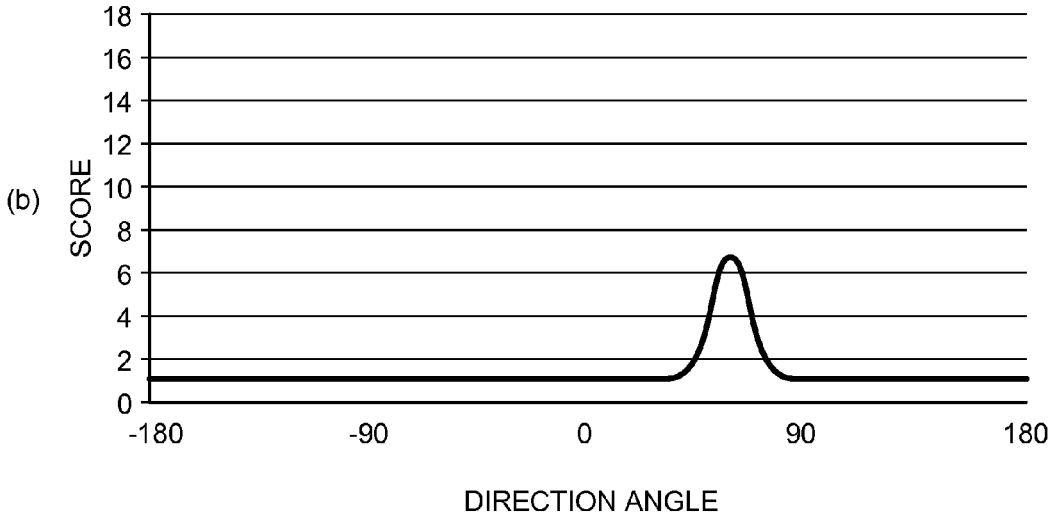
Figure 22:
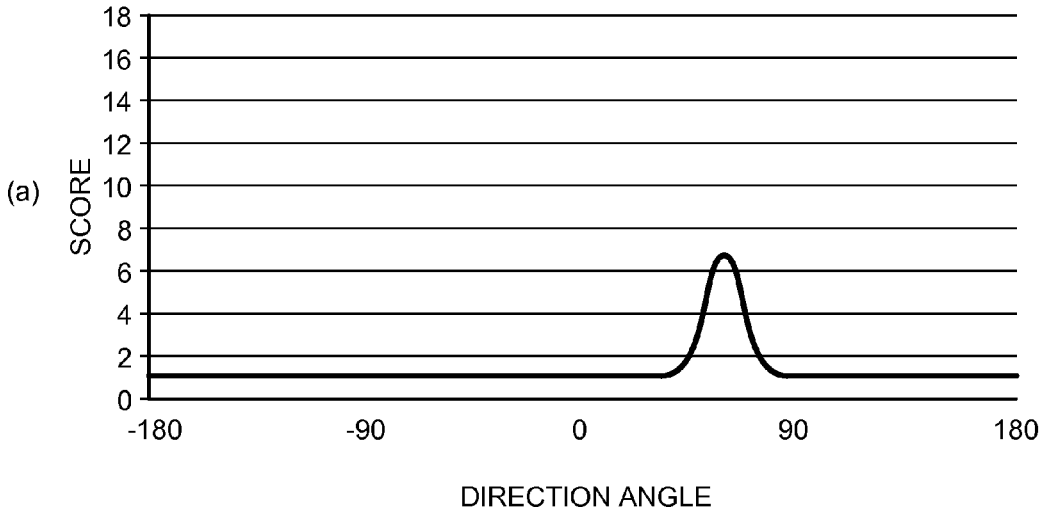
FIG. 22 illustrates examples of omnidirectional scores converted from scores.
Figure 22:
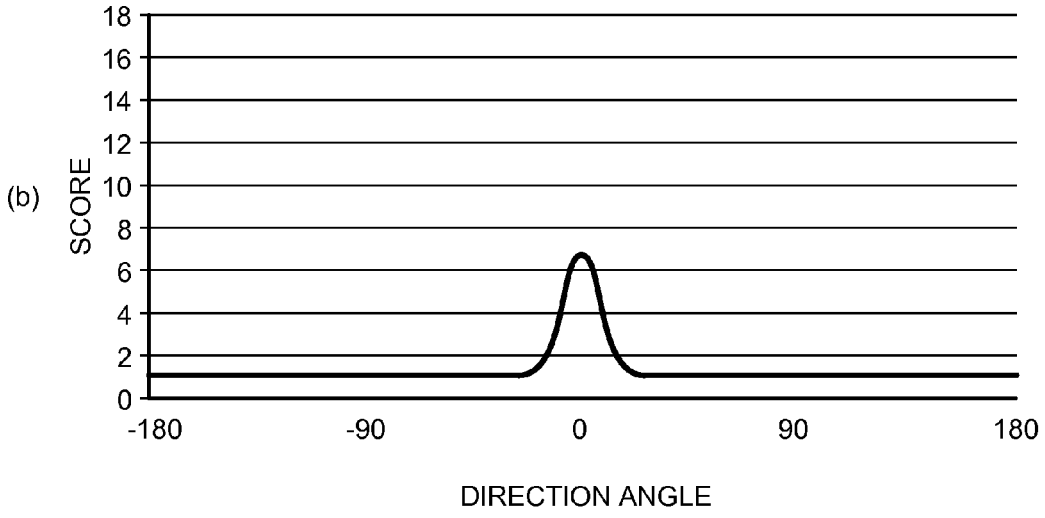

Similarly, scores obtained by performing the processing similar to that in the first embodiment for the acoustic signals of two channels acquired from two microphones M2 and M3 are converted into omnidirectional scores in consideration of the arrangement of the microphone M2 and the microphone M3, so as to obtain first candidate scores illustrated in (a) in FIG. 21 and second candidate scores illustrated in (b) in FIG. 21. Similarly, scores obtained by performing the processing similar to that in the first embodiment for the acoustic signals of two channels acquired from two microphones M3 and M1 are converted into omnidirectional scores in consideration of the arrangement of the microphone M3 and the microphone M1, so as to obtain first candidate scores illustrated in (a) in FIG. 22 and second candidate scores illustrated in (b) in FIG. 22.

Figure 23:
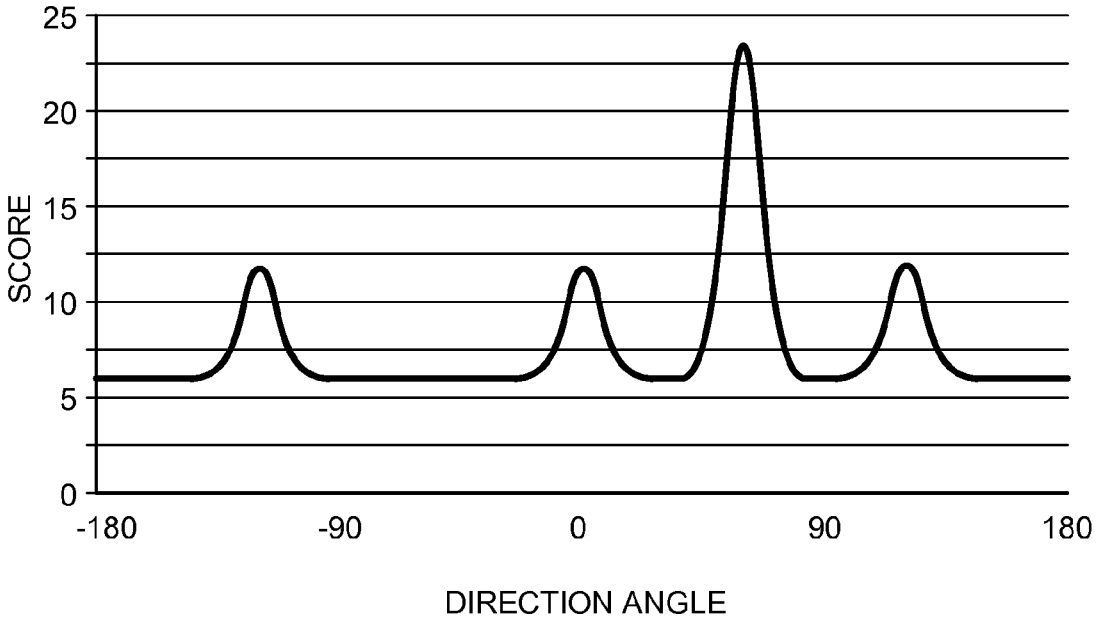
FIG. 23 is a diagram illustrating an example of integrated scores in which the omnidirectional scores are integrated.

Finally, by accumulating the omnidirectional scores obtained from the acoustic signals of any two channels, integrated scores illustrated in FIG. 23 are generated. The omnidirectional scores obtained from the acoustic signals of any two channels include two candidates such as first candidate scores and second candidate scores as described above. However, the scores in the direction where the sound source SS actually exists are the same in all of the combinations of two channels. For this reason, by accumulating the omnidirectional scores obtained from the acoustic signals of any two channels, there can be obtained integrated scores in which the score in the direction where the sound source SS exists is high, as illustrated in FIG. 23. In an example illustrated in FIG. 23, since the score in the direction of a direction angle of 60 degrees is the highest, the direction of the sound source SS can be estimated as being 60 degrees.

Here, in the above description, the acoustic signals of three channels acquired from three microphones M1, M2 and M3 are used to estimate a sound source direction omnidirectionally on the same plane. However, when acoustic signals of four or more channels acquired from four or more microphones are used, the estimation can be performed not only on the same plane but also in a spatial direction, based on a similar principle. Also, by increasing the number of microphones for acquiring acoustic signals thereby to increase the number of combinations of acoustic signals for generating phase difference distributions and accumulating the scores, the influence of an outlier can be reduced to improve the estimation accuracy of a sound source direction.

The sound source direction estimation apparatuses according to the embodiments described above can be achieved by, for example, using a general-purpose computer device as basic hardware. That is, the sound source direction estimation apparatuses according to the embodiments can be achieved by causing a processor installed in a general-purpose computer device to execute a program. Here, the sound source direction estimation apparatuses may be achieved by previously installing the above-described program in a computer device, or may be achieved by storing the program in a storage medium such as a CD-ROM or distributing the above-described program through a network to appropriately install this program in a computer device. Also, the sound source direction estimation apparatuses may be achieved by executing the above-described program on a server computer device and allowing a result thereof to be received by a client computer device through a network.

Also, various information to be used in the sound source direction estimation apparatuses according to the embodiments described above can be stored by appropriately utilizing a memory and a hard disk built in or externally attached to the above-described computer device, or a storage medium such as a CD-R, a CD-RW, a DVD-RAM and a DVD-R, which may be provided as a computer program product. For example, templates to be used by the sound source direction estimation apparatuses according to the embodiments described above can be stored by appropriately utilizing the storage medium.

Programs to be executed in the sound source direction estimation apparatuses according to the embodiments have a module structure containing the processing units that constitute the sound source direction estimation apparatus (the acquisition unit 11, the generator 12, the comparator 13 (the comparators 21 and 32), the estimator 15 (the estimators 42 and 51), and the output unit 16). As actual hardware, for example, a processor reads a program from the above-described storage medium and executes the read program to load and generate the above-described processing units on a main memory. The sound source direction estimation apparatuses according to the present embodiments can also achieve a portion or all of the above-described processing units by utilizing dedicated hardware such as an ASIC (Application Specific Integrated Circuit) and an FPGA (Field-Programmable Gate Array).

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sound source direction estimation apparatus comprising:

circuitry configured to implement:

an acquisition unit configured to acquire acoustic signals of a plurality of channels from a plurality of microphones;

a generator configured to calculate a phase difference of the acoustic signals of the plurality of channels for each predetermined frequency bin to generate a phase difference distribution;

a comparator configured to compare the phase difference distribution with a template generated in advance for each direction, and calculate a score in accordance with similarity between the phase difference distribution and the template for each direction so that the score for a direction corresponding to the template becomes higher as the similarity between the phase difference distribution and the template is higher; and an estimator configured to estimate a direction of a sound source based on the calculated score, wherein the comparator includes:

a quantizer configured to perform a quantization on the phase difference distribution; and a score calculator configured to compare the quantized phase difference distribution with the template obtained by performing the quantization on a phase difference distribution calculated in advance for each direction, and calculate as the score the number of frequency bins where quantized phase differences in the phase difference distribution and in the template are identical.

2. The apparatus according to claim 1, wherein the estimator is configured to generate a score waveform having the scores arranged in an order of direction angle, detect local maximum values of the score waveform, select local maximum values in a designated number in a descending order of the score among the detected local maximum values, and estimate that the directions of sound sources are directions corresponding to the respective selected local maximum values.

3. The apparatus according to claim 1, wherein the estimator is configured to generate a score waveform having the scores arranged in an order of direction angle, detect local maximum values of the score waveform, select local maximum values each having the score higher than a predetermined threshold value among the detected local maximum values, and estimate that the directions of sound sources are directions corresponding to the respective selected local maximum values.

4. The apparatus according to claim 1, wherein the comparator is configured to select a number of templates in accordance with a designated angle resolution among the templates generated in advance for individual directions, compare the phase difference distribution with each of the selected templates, and calculate the scores for individual directions corresponding to the designated angle resolution.

5. The apparatus according to claim 1, wherein the circuitry comprises a processor.

6. The apparatus according to claim 1, wherein the circuitry comprises dedicated circuitry.

7. The apparatus according to claim 1, wherein the estimator is configured to estimate a direction of a sound source that is a direction corresponding to a highest score.

8. A sound source direction estimation apparatus comprising:

circuitry configured to implement:

an acquisition unit configured to acquire acoustic signals of a plurality of channels from a plurality of microphones;

a generator configured to calculate a phase difference of the acoustic signals of the plurality of channels for each predetermined frequency bin to generate a phase difference distribution;

a comparator configured to compare the phase difference distribution with a template generated in advance for each direction, and calculate a score in accordance with similarity between the phase difference distribution and the template for each direction so that the score for a direction corresponding to the template becomes higher as the similarity between the phase difference distribution and the template is higher; and an estimator configured to estimate a direction of a sound source based on the calculated score, wherein the comparator includes a quantizer configured to perform a quantization on the phase difference distribution;

a setting unit configured to set an additional score for each frequency bin based on the acoustic signal; and a score calculator configured to compare the quantized phase difference distribution with the template obtained by performing the quantization on a phase difference distribution calculated in advance for each direction, and calculate as the score a sum of additional scores set for the respective frequency bins where quantized phase differences in the phase difference distribution and in the template are identical.

9. The apparatus according to claim 8, wherein the setting unit is configured to set the additional score in accordance with a magnitude of a log power of an acoustic signal in each frequency bin.

10. The apparatus according to claim 8, wherein the setting unit is configured to set the additional score in accordance with a magnitude of a signal/noise ratio of an acoustic signal in each frequency bin.

11. The apparatus according to claim 8, wherein the circuitry comprises a processor.

12. The apparatus according to claim 8, wherein the circuitry comprises dedicated circuitry.

13. The apparatus according to claim 8, wherein the estimator is configured to estimate a direction of a sound source that is a direction corresponding to a highest score.

14. A sound source direction estimation method executed in a sound source direction estimation apparatus, the method comprising:

acquiring acoustic signals of a plurality of channels from a plurality of microphones;

calculating a phase difference of the acoustic signals of the plurality of channels for each predetermined frequency bin to generate a phase difference distribution;

comparing the phase difference distribution with a template generated in advance for each direction;

calculating a score in accordance with similarity between the phase difference distribution and the template for each direction so that the score for a direction corresponding to the template becomes higher as the similarity between the phase difference distribution and the template is higher; and estimating a direction of a sound source based on the calculated score, wherein the comparing includes performing a quantization on the phase difference distribution and comparing the quantized phase difference distribution with the template obtained by performing the quantization on a phase difference distribution calculated in advance for each direction; and the calculating of the score includes calculating as the score the number of frequency bins where quantized phase differences in the phase difference distribution and in the template are identical.

15. The method according to claim 14, wherein the estimating estimates a direction of a sound source that is a direction corresponding to a highest score.

16. A computer program product comprising a non-transitory computer-readable medium containing a program executed by a computer, the program causing the computer to execute at least:

acquiring acoustic signals of a plurality of channels from a plurality of microphones;

calculating a phase difference of the acoustic signals of the plurality of channels for each predetermined frequency bin to generate a phase difference distribution;

comparing the phase difference distribution with a template generated in advance for each direction;

calculating a score in accordance with similarity between the phase difference distribution and the template for each direction so that the score for a direction corresponding to the template becomes higher as the similarity between the phase difference distribution and the template is higher; and estimating a direction of a sound source based on the calculated score, wherein the comparing includes performing a quantization on the phase difference distribution and comparing the quantized phase difference distribution with the template obtained by performing the quantization on a phase difference distribution calculated in advance for each direction; and the calculating of the score includes calculating as the score the number of frequency bins where quantized phase differences in the phase difference distribution and in the template are identical.

17. The computer program product according to claim 16, wherein the estimating estimates a direction of a sound source that is a direction corresponding to a highest score.

* * * * *